US007922406B2

(12) United States Patent
Sawai et al.

(10) Patent No.: US 7,922,406 B2
(45) Date of Patent: Apr. 12, 2011

(54) IMAGE GENERATING APPARATUS

(75) Inventors: Kunio Sawai, Daito (JP); Takahiro Naito, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 666 days.

(21) Appl. No.: 12/027,489

(22) Filed: Feb. 7, 2008

(65) Prior Publication Data

US 2008/0193185 A1 Aug. 14, 2008

(30) Foreign Application Priority Data

Feb. 8, 2007 (JP) ..... 2007-028675

(51) Int. Cl.
*B41J 25/304* (2006.01)

(52) U.S. Cl. ..... 400/120.16; 347/197

(58) Field of Classification Search ..... 400/120.16, 400/120.17; 347/197, 198
See application file for complete search history.

(56) References Cited

U.S. PATENT DOCUMENTS 5,071,266 A * 12/1991 Harada et al. ..... 400/120.17
5,672,017 A 9/1997 Taniguchi
2003/0050121 A1 3/2003 Takada et al.
2005/0062834 A1* 3/2005 Sawai ..... 347/220
2006/0082636 A1* 4/2006 Maruyama ..... 347/197

FOREIGN PATENT DOCUMENTS

| | | | |
|---|---|---|---|
| JP | 03133678 | A * | 6/1991 |
| JP | 6-39980 | Y2 | 10/1994 |
| JP | 7-251554 | A | 10/1995 |
| JP | 7-251564 | A | 10/1995 |
| JP | 7-269589 | A | 10/1995 |
| JP | 7-269689 | A | 10/1995 |
| JP | 8-62688 | A | 3/1996 |
| JP | 2756029 | B2 | 3/1998 |
| JP | 3177126 | B2 | 4/2001 |
| JP | 3272627 | B2 | 1/2002 |
| JP | 2003-156066 | A | 5/2003 |
| JP | 2003-266859 | A | 9/2003 |
| JP | 3817732 | B2 | 6/2006 |

* cited by examiner

*Primary Examiner* — Daniel J Colilla
(74) *Attorney, Agent, or Firm* — Crowell & Moring LLP

(57) ABSTRACT

In this image generating apparatus, a driving gear portion is so formed that the diameter of the outer peripheral surface of a first toothless portion is smaller than the tip diameter of a first toothed portion, and so arranged that the first toothless portion thereof slides on a second toothed portion of a driven gear portion of a print head rotating member in the vicinity of a position where a print head presses a platen roller with a pressing portion.

16 Claims, 14 Drawing Sheets

IMAGE GENERATING APPARATUS

BACKGROUND OF THE INVENTION

1. Field of the Invention

The present invention relates to an image generating apparatus comprising a print head printing images while pressing a platen roller with prescribed pressing force.

2. Description of the Background Art

An image generating apparatus comprising a print head printing images while pressing a platen roller with prescribed pressing force and the like is known in general, as disclosed in each of Japanese Patent Nos. 3817732, 2756029 and 3177126, and Japanese Patent Laying-Open Nos. 2003-266859 and 6-39980 (1994), for example.

The aforementioned Japanese Patent No. 3817732 discloses a thermal transfer printer (image generating apparatus) comprising a cam gear, a driving gear, a shaft member (rotational member) having driving gear mounting portions and synchronous cam portions integrally provided on both ends of a rotating shaft respectively and a thermal head (print head) supported by an arm through a spring. In the thermal transfer printer (image generating apparatus) described in Japanese Patent No. 3817732, control bosses provided on the arm supporting the thermal head engage with notches formed on the driving gear mounting portions of the shaft member when the cam gear and the driving gear mounted on the shaft member through the driving gear mounting portions mesh with each other to rotate the shaft member by a prescribed angle, thereby regulating rotation of the thermal head.

The aforementioned Japanese Patent No. 2756029 discloses a printer driving mechanism comprising a swing gear driven by a drive motor, a swing plate mounted with a head-down gear and a head-up gear and swung by the swing gear, a cam gear and a head separating cam lever engaging with the cam gear. In the printer driving mechanism described in Japanese Patent No. 2756029, the head-down gear or the head-up gear selectively meshes with the cam gear due to an operation of the swing plate interlocking with the swing gear, for vertically rotating the print head through the head separating cam lever engaging with the cam gear. When the head-down gear engages with an intermittent portion (toothless portion) provided on the cam gear by meshing with the cam gear, rotation of the cam gear is stopped regardless of rotation of the swing gear driven by the drive motor.

The aforementioned Japanese Patent Laying-Open No. 2003-266859 discloses an ink jet recording apparatus (image generating apparatus) comprising a recording paper transportation motor and PG (paper gap) control means capable of vertically moving a carriage loaded with a recording head by successively meshing an endless belt, a plurality of transmission gears, a PG control gear and a swing portion with a pulley driven by the recording paper transportation motor. In the ink jet recording apparatus (image generating apparatus) described in Japanese Patent Laying-Open No. 2003-266859, the swing portion rotates by a prescribed angle for vertically moving a carriage guide shaft provided independently of the swing portion, thereby vertically rotating the carriage loaded with the recording head.

The aforementioned Japanese Patent No. 3177126 discloses a thermal printer (image generating apparatus) capable of reciprocating a carriage loaded with a thermal head in the cross direction of papers by successively meshing a carriage driving gear, a transmission gear and a roller driving gear with a stepping motor and an idle gear (intermediate gear) driven by the stepping motor. In the thermal printer (image generating apparatus) described in Japanese Patent No. 3177126, the carriage driving gear rotates by a prescribed angle, thereby moving the carriage loaded with the thermal head in the cross direction of the papers through a carriage driving shaft provided independently of the carriage driving gear.

The aforementioned Japanese Patent No. 6-39980 discloses a print head for a printer comprising a head motor, a driving gear rotated by the head motor and a head cam integrally provided with a gear portion meshing with the driving gear and a cam portion for applying pressing force to a pressing mechanism for a thermal head. In the print head for a printer described in Japanese Patent No. 6-39980, the driving gear rotates by a prescribed angle, thereby pressing the thermal head toward a platen through the head cam and the pressing mechanism. In the print head for a printer described in Japanese Patent No. 6-39980, the driving gear is in mesh with the gear portion of the head cam regardless of the operation of pressing the thermal head.

In the thermal transfer printer (image generating apparatus) described in the aforementioned Japanese Patent No. 3817732, however, rotation of the thermal head is regulated by the engagement between the control bosses of the thermal head and the notches of the driving gear mounting portions, whereby the engagement between the control bosses and the notches may conceivably be incomplete if the accuracy of the rotation angle of the cam gear is insufficient. In this case, constant pressing force cannot be obtained for the thermal head (print head). In the thermal transfer printer described in the aforementioned Japanese Patent No. 3817732, further, the driving gear is provided independently of the shaft member, whereby the number of components of the thermal transfer printer is disadvantageously increased.

In the printer driving mechanism described in the aforementioned Japanese Patent No. 2756029, the head-down gear is continuously rotated by the driving motor in the state engaging with the intermittent portion (toothless portion) of the cam gear when the print head presses the platen, whereby a toothed portion of the head-down gear may periodically come into contact with the intermittent portion of the cam gear, to vibrate the cam gear. If such vibration of the cam gear is propagated from the cam gear to the head separating cam lever, the head separating cam lever cannot apply constant pressing force to the print head due to jolting resulting from the vibration.

In the ink jet recording apparatus (image generating apparatus) described in the aforementioned Japanese Patent Laying-Open No. 2003-266859, the carriage guide shaft vertically moving the carriage is provided independently of the swing portion, whereby the number of components of the apparatus is disadvantageously increased.

Also in the thermal printer (image generating apparatus) described in the aforementioned Japanese Patent No. 3177126, the carriage driving shaft reciprocating the carriage is provided independently of the carriage driving gear, whereby the number of components of the thermal printer is disadvantageously increased.

In the print head for a printer described in the aforementioned Japanese Patent Laying-Open No. 6-39980 (1994), the driving gear is regularly in mesh with the gear portion of the head cam, whereby the rotation angle of the head cam is conceivably inconstant if the accuracy of the rotation angle of the driving gear is insufficient. In this case, constant pressing force cannot be obtained for the thermal head (print head).

SUMMARY OF THE INVENTION

The present invention has been proposed in order to solve the aforementioned problems, and an object of the present invention is to provide an image generating apparatus capable of suppressing increase in the number of components and obtaining constant pressing force for a print head.

An image generating apparatus according to a first aspect of the present invention comprises a print head for printing images while pressing a platen roller with prescribed pressing force, a driving gear portion including a first toothed portion provided in a prescribed rotation angle range and a first toothless portion provided on a region other than the first toothed portion and a print head rotating member integrally including a driven gear portion having a second toothed portion provided in the prescribed rotation angle range and a second toothless portion provided on a region other than the second toothed portion for meshing with the driving gear portion and a pressing portion pressing the print head, while the driving gear portion is so formed that the diameter of the outer peripheral surface of the first toothless portion is smaller than the tip diameter of the first toothed portion, and the driving gear portion is so arranged that the first toothless portion of the driving gear portion slides on the second toothed portion of the driven gear portion of the print head rotating member in the vicinity of a position where the print head presses the platen roller with the pressing portion of the print head rotating member.

As hereinabove described, the image generating apparatus according to the first aspect comprises the print head rotating member integrally including the driven gear portion meshing with the driving gear portion and the pressing portion pressing the print head so that the driven gear portion and the pressing portion may not be provided independently of the print head rotating member, whereby increase in the number of components forming the body of the image generating apparatus can be suppressed. Further, the driving gear portion is so arranged that the first toothless portion of the driving gear portion slides on the second toothed portion of the driven gear portion of the print head rotating member in the vicinity of the position where the print head presses the platen roller with the pressing portion of the print head rotating member so that the first toothless portion of the driving gear portion is slidably in contact with the second toothed portion of the driven gear portion of the print head rotating member in the vicinity of the position where the print head presses the platen roller with the pressing portion of the print head rotating member, whereby the rotational position of the print head rotating member is inhibited from changing even if the rotation angle of the driving gear portion is dispersed. Consequently, the pressing portion of the print head rotating member can apply constant pressing force to the print head. In addition, the driving gear portion is so formed that the diameter of the outer peripheral surface of the first toothless portion is smaller than the tip diameter of the first toothed portion so that the second toothed portion of the driven gear portion of the print head rotating member slides on the first toothless portion having the diameter smaller than the tip diameter of the first toothed portion of the driving gear portion, whereby the circumferential sliding length of the first toothless portion resulting from dispersion in the rotation angle of the driving gear portion can be reduced. Therefore, the first toothless portion of the driving gear portion and the second toothed portion of the driven gear portion can be inhibited from wear resulting from sliding.

In the aforementioned image generating apparatus according to the first aspect, the second toothed portion of the driven gear portion is preferably constituted of a third toothed portion and a fourth toothed portion provided in the prescribed rotation angle range, the tip diameter of the third toothed portion is preferably larger than the tip diameter of the fourth toothed portion while at least one end of the fourth toothed portion is preferably arranged adjacently to the third toothed portion, and the first toothed portion of the driving gear portion and the third toothed portion of the driven gear portion preferably first mesh with each other when the driving gear portion and the driven gear portion of the print head rotating member mesh with each other. According to this structure, the third toothed portion of the driven gear portion having the larger tip diameter first meshes with the first toothed portion of the driving gear portion when the driving gear portion starts meshing with the driven gear portion, whereby the driving gear portion can reliably mesh with the driven gear portion.

In this case, the root diameter of the first toothed portion of the driving gear portion engaging with the third toothed portion of the driven gear portion is preferably smaller than the diameter of the outer peripheral surface of the first toothless portion. According to this structure, the tip (addendum) of the third toothed portion of the driven gear portion is inhibited from interfering with the bottom of the corresponding first toothed portion of the driving gear portion (more strictly, the bottom of the portion where the first toothed portion and the first toothless portion are connected with each other) when the driving gear portion starts meshing with the driven gear portion due to the root diameter, smaller than the diameter of the outer peripheral surface of the first toothless portion, of the first toothed portion of the driving gear portion meshing with the third toothed portion of the driven gear portion. Therefore, the driving gear portion and the driven gear portion can smoothly mesh with each other.

In the aforementioned image generating apparatus according to the first aspect, the driven gear portion preferably further has a fifth toothed portion provided on another region of the driven gear portion other than the second toothed portion and the second toothless portion, and the third toothed portion and the fifth toothed portion of the driven gear portion preferably hold the driving gear portion over the first toothless portion of the driving gear portion when the first toothed portion of the driving gear portion and the second toothed portion of the driven gear portion of the print head rotating member are out of mesh. According to this structure, the driven gear portion can come into contact with the first toothless portion of the driving gear portion through the third and fifth toothed portions, whereby the driven gear portion can reliably hold the rotational position with respect to the first toothless portion of the driving gear portion through the third and fifth toothed portions.

In the aforementioned image generating apparatus according to the first aspect, the pressing portion of the print head rotating member is preferably so arranged as to press a portion around the cross-directional center of the print head. According to this structure, the pressing portion of the print head rotating member can press the print head with pressing force horizontally uniform with respect to the cross direction of the print head. Thus, the print head can uniformly come into contact with the platen roller.

In the aforementioned image generating apparatus according to the first aspect, the number of bottoms of the first toothed portion of the driving gear portion is preferably identical to the number of tips of the second toothed portion of the driven gear portion. According to this structure, the driving gear portion can easily rotate the driven gear portion from a prescribed position at a constant rotation angle, whereby the rotation angle of the driven gear portion can be inhibited from dispersion every rotation.

In the aforementioned image generating apparatus according to the first aspect, the driving gear portion is preferably so arranged that the first toothless portion of the driving gear portion slides on the side surface of one end of the second toothed portion of the driven gear portion in the vicinity of a position where the print head presses the platen roller with the pressing portion of the print head rotating member. According to this structure, the driven gear portion can so easily slide that the rotational position of the print head rotating member can be easily inhibited from changing in printing.

In the aforementioned image generating apparatus according to the first aspect, the print head rotating member preferably further includes a heat radiating member mounted on the print head for radiating heat generated in the print head, the pressing portion of the print head rotating member is preferably rendered rotatable, the heat radiating member is preferably integrally provided with a push-up portion pushed up by the pressing portion upon rotation of the pressing portion, and the push-up portion of the heat radiating member is preferably so pushed up by the pressing portion upon rotation of the pressing portion that the heat radiating member and the print head move in a direction for separating from the platen roller. According to this structure, the pressing portion pushes up the push-up portion with rotational force upon rotation without requiring a transmission mechanism portion transmitting the rotational force to the heat radiating member and the print head, thereby easily rotating the heat radiating member and the print head in the direction for separating from the platen roller. Consequently, increase in the number of components can be further suppressed.

In this case, the pressing portion preferably presses the print head toward the platen roller in printing, and the heat radiating member preferably includes a deviation preventing portion preventing the pressing portion from deviating in the rotational direction when the pressing portion presses the print head toward the platen roller in printing. According to this structure, the pressing portion does not deviate in the rotational direction in printing, to be capable of reliably pressing the print head toward the platen roller.

In the aforementioned image generating apparatus according to the first aspect, the pressing portion of the print head rotating member is preferably made of resin. According to this structure, noise resulting from the pressing portion sliding on a support rod of metal upon rotation can be suppressed as compared with a case where the pressing portion is made of metal.

An image generating apparatus according to a second aspect of the present invention comprises a print head for printing images while pressing a platen roller with prescribed pressing force, a driving gear portion including a first toothed portion provided in a prescribed rotation angle range and a first toothless portion provided on a region other than the first toothed portion and a print head rotating member integrally including a driven gear portion having a second toothed portion provided in the prescribed rotation angle range and a second toothless portion provided on a region other than the second toothed portion for meshing with the driving gear portion and a pressing portion so arranged as to press a portion around the cross-directional center of the print head, the driving gear portion is so formed that the diameter of the outer peripheral surface of the first toothless portion is smaller than the tip diameter of the first toothed portion, the driving gear portion is so arranged that the first toothless portion of the driving gear portion slides on the second toothed portion of the driven gear portion of the print head rotating member in the vicinity of a position where the print head presses the platen roller with the pressing portion of the print head rotating member, the second toothed portion of the driven gear portion is constituted of a third toothed portion and a fourth toothed portion provided in the prescribed rotation angle range while the driven gear portion further has a fifth toothed portion provided on another region of the driven gear portion other than the second toothed portion and the second toothless portion, the tip diameter of the third toothed portion is larger than the tip diameter of the fourth toothed portion while at least one end of the fourth toothed portion is arranged adjacently to the third toothed portion, the first toothed portion of the driving gear portion and the third toothed portion of the driven gear portion first mesh with each other when the driving gear portion and the driven gear portion of the print head rotating member mesh with each other, the root diameter of the first toothed portion of the driving gear portion engaging with the third toothed portion of the driven gear portion is smaller than the diameter of the outer peripheral surface of the first toothless portion, and the third toothed portion and the fifth toothed portion of the driven gear portion hold the driving gear portion over the first toothless portion of the driving gear portion when the first toothed portion of the driving gear portion and the second toothed portion of the driven gear portion of the print head rotating member are out of mesh.

As hereinabove described, the image generating apparatus according to the second aspect comprises the print head rotating member integrally including the driven gear portion meshing with the driving gear portion and the pressing portion pressing the print head so that the driven gear portion and the pressing portion may not be provided independently of the print head rotating member, whereby increase in the number of components forming the body of the image generating apparatus can be suppressed. Further, the driving gear portion is so arranged that the first toothless portion of the driving gear portion slides on the second toothed portion of the driven gear portion of the print head rotating member in the vicinity of the position where the print head presses the platen roller with the pressing portion of the print head rotating member so that the first toothless portion of the driving gear portion is slidably in contact with the second toothed portion of the driven gear portion of the print head rotating member in the vicinity of the position where the print head presses the platen roller with the pressing portion of the print head rotating member, whereby the rotational position of the print head rotating member is inhibited from changing even if the rotation angle of the driving gear portion is dispersed. Consequently, the pressing portion of the print head rotating member can apply constant pressing force to the print head. In addition, the driving gear portion is so formed that the diameter of the outer peripheral surface of the first toothless portion is smaller than the tip diameter of the first toothed portion so that the second toothed portion of the driven gear portion of the print head rotating member slides on the first toothless portion having the diameter smaller than the tip diameter of the first toothed portion of the driving gear portion, whereby the circumferential sliding length of the first toothless portion resulting from dispersion in the rotation angle of the driving gear portion can be reduced. Therefore, the first toothless portion of the driving gear portion and the second toothed portion of the driven gear portion can be inhibited from wear resulting from sliding.

In the image generating apparatus according to the second aspect, further, the second toothed portion of the driven gear portion is constituted of the third toothed portion and the fourth toothed portion provided in the prescribed rotation angle range, the tip diameter of the third toothed portion is larger than the tip diameter of the fourth toothed portion while at least one end of the fourth toothed portion is arranged adjacently to the third toothed portion, and the first toothed portion of the driving gear portion and the third toothed portion of the driven gear portion first mesh with each other when the driving gear portion and the driven gear portion of the print head rotating member mesh with each other so that the third toothed portion of the driven gear portion having the larger tip diameter first meshes with the first toothed portion of the driving gear portion when the driving gear portion starts meshing with the driven gear portion, whereby the driving gear portion can reliably mesh with the driven gear portion. In addition, the root diameter of the first toothed portion of the driving gear portion engaging with the third toothed portion of the driven gear portion is smaller than the diameter of the outer peripheral surface of the first toothless portion, whereby the tip (addendum) of the third toothed portion of the driven gear portion is inhibited from interfering with the bottom of the corresponding first toothed portion of the driving gear portion (more strictly, the bottom of the portion where the first toothed portion and the first toothless portion are connected with each other) when the driving gear portion starts meshing with the driven gear portion due to the root diameter, smaller than the diameter of the outer peripheral surface of the first toothless portion, of the first toothed portion of the driving gear portion meshing with the third toothed portion of the driven gear portion. Therefore, the driving gear portion and the driven gear portion can smoothly mesh with each other.

In the image generating apparatus according to the second aspect, the driven gear portion further has the fifth toothed portion provided on the region of the driven gear portion other than the second toothed portion and the second toothless portion, and the third toothed portion and the fifth toothed portion of the driven gear portion hold the driving gear portion over the first toothless portion of the driving gear portion when the first toothed portion of the driving gear portion and the second toothed portion of the driven gear portion of the print head rotating member are out of mesh so that the driven gear portion can come into contact with the first toothless portion of the driving gear portion through the third and fifth toothed portions, whereby the driven gear portion can reliably hold the rotational position with respect to the first toothless portion of the driving gear portion through the third and fifth toothed portions. Further, the pressing portion of the print head rotating member is so arranged as to press the portion around the cross-directional center of the print head, whereby the pressing portion of the print head rotating member can press the print head with pressing force horizontally uniform with respect to the cross direction of the print head. Thus, the print head can uniformly come into contact with the platen roller.

In the aforementioned image generating apparatus according to the second aspect, the number of bottoms of the first toothed portion of the driving gear portion is preferably identical to the number of tips of the second toothed portion of the driven gear portion. According to this structure, the driving gear portion can easily rotate the driven gear portion from a prescribed position at a constant rotation angle, whereby the rotation angle of the driven gear portion can be inhibited from dispersion every rotation.

In the aforementioned image generating apparatus according to the second aspect, the driving gear portion is preferably so arranged that the first toothless portion of the driving gear portion slides on the side surface of one end of the second toothed portion of the driven gear portion in the vicinity of the position where the print head presses the platen roller with the pressing portion of the print head rotating member. According to this structure, the driven gear portion can so easily slide that the rotational position of the print head rotating member can be easily inhibited from changing in printing.

In the aforementioned image generating apparatus according to the second aspect, the print head rotating member preferably further includes a heat radiating member mounted on the print head for radiating heat generated in the print head, the pressing portion of the print head rotating member is preferably rendered rotatable, the heat radiating member is preferably integrally provided with a push-up portion pushed up by the pressing portion upon rotation of the pressing portion, and the push-up portion of the heat radiating member is preferably so pushed up by the pressing portion upon rotation of the pressing portion that the heat radiating member and the print head move in a direction for separating from the platen roller. According to this structure, the pressing portion pushes up the push-up portion with rotational force upon rotation without requiring a transmission mechanism portion transmitting the rotational force to the heat radiating member and the print head, thereby easily rotating the heat radiating member and the print head in the direction for separating from the platen roller. Consequently, increase in the number of components can be further suppressed.

In this case, the pressing portion preferably presses the print head toward the platen roller in printing, and the heat radiating member preferably includes a deviation preventing portion preventing the pressing portion from deviating in the rotational direction when the pressing portion presses the print head toward the platen roller in printing. According to this structure, the pressing portion does not deviate in the rotational direction in printing, to be capable of reliably pressing the print head toward the platen roller.

In the aforementioned image generating apparatus according to the second aspect, the pressing portion of the print head rotating member is preferably made of resin. According to this structure, noise resulting from the pressing portion sliding on a support rod of metal upon rotation can be suppressed as compared with a case where the pressing portion is made of metal.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention are now described with reference to the drawings.

First Embodiment

First, the structure of a sublimatic printer according to a first embodiment of the present invention is described with reference to FIGS. 1 to 11. According to the first embodiment, the present invention is applied to the sublimatic printer employed as an exemplary image generating apparatus.

Figure 1:
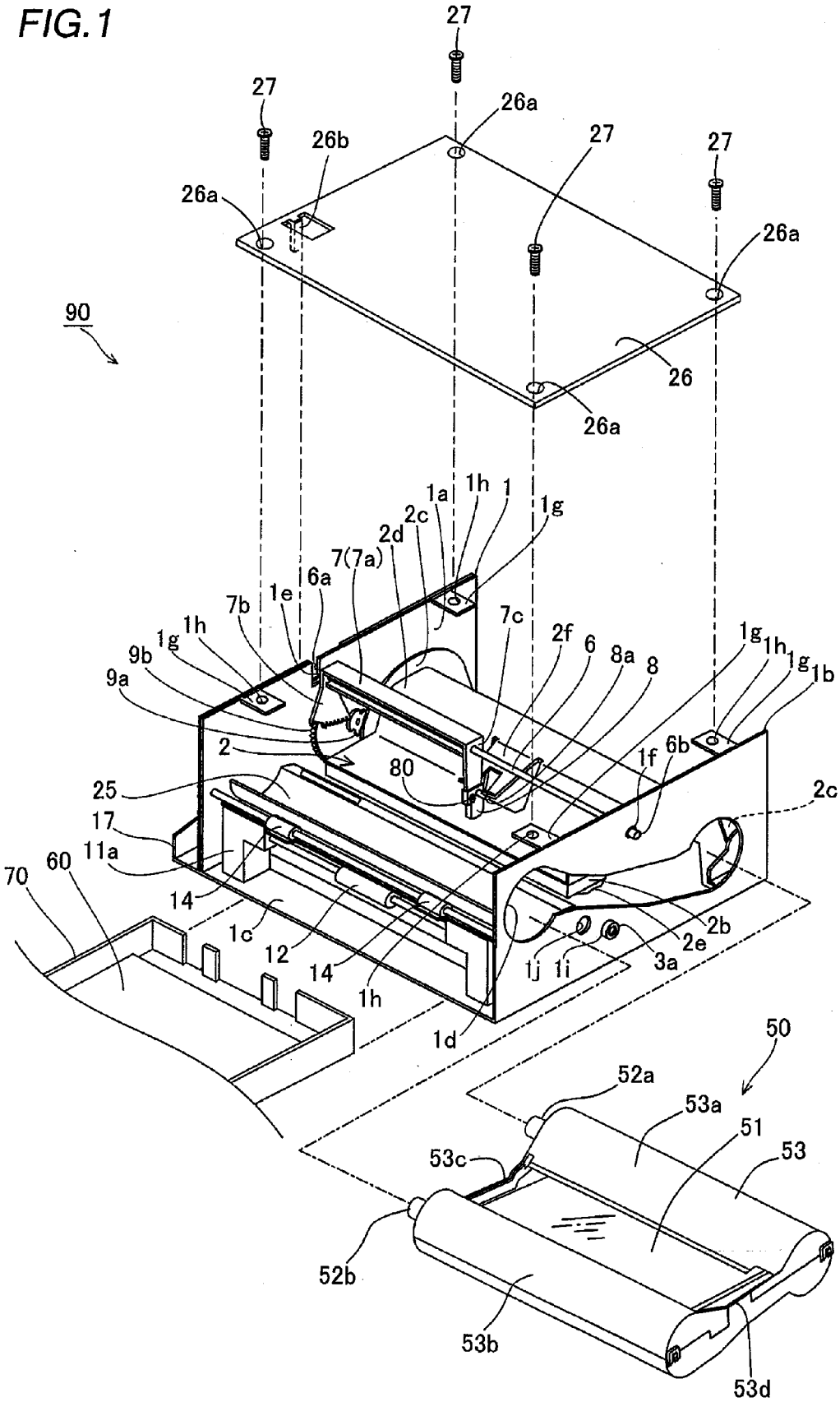
FIG. 1 is an exploded perspective view showing the overall structure of a sublimatic printer according to a first embodiment of the present invention.
Figure 3:
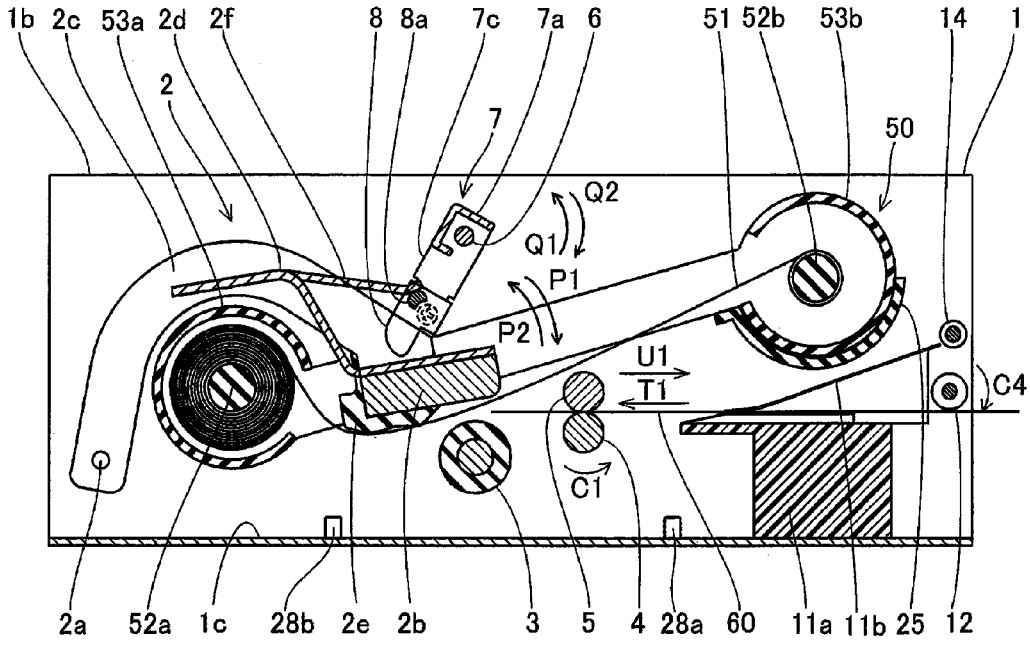
FIG. 3 illustrates the internal structure of the sublimatic printer according to the first embodiment shown in FIG. 1.
Figure 4:
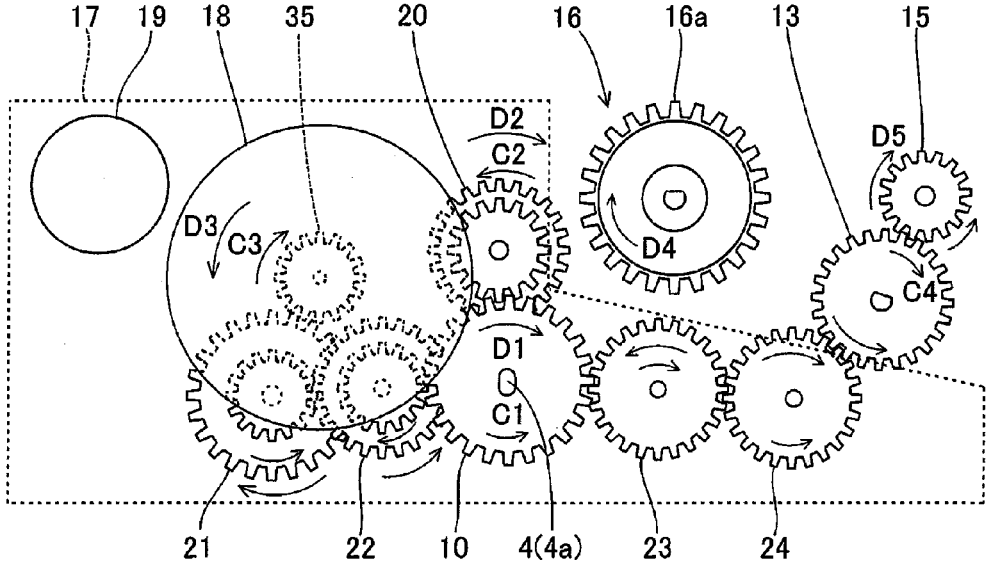
FIG. 4 is a side elevational view showing the arrangement of stepping motors and gears in the sublimatic printer according to the first embodiment shown in FIG. 1.

As shown in FIG. 1, a printer body 90 of the sublimatic printer according to the first embodiment of the present invention comprises a chassis 1 of metal (sheet metal), a print head 2 for printing images, a platen roller 3 (see FIG. 3) opposed to the print head 2, a feed roller 4 (see FIG. 3) of metal, a press roller 5 (see FIG. 3) of metal pressing the feed roller 4 with prescribed pressing force, a support rod 6 of metal, a print head rotating member 7 of sheet metal, a head portion pressing member 8 of resin for pressing the print head 2, a driving gear 9 of resin and a feed roller gear 10 (see FIG. 4). The printer body 90 of the sublimatic printer further comprises a lower paper guide 11*a* of resin, an upper paper guide 11*b* (see FIG. 3) of resin, a paper feed roller 12 of rubber, a paper feed roller gear 13 (see FIG. 2), a paper discharge roller 14 of rubber, a paper discharge roller gear 15 (see FIG. 2), a take-up reel 16 (see FIG. 2), a motor bracket 17 (see FIG. 2) of sheet metal, a stepping motor 18 (see FIG. 2) for transporting papers 60, another stepping motor 19 (see FIG. 2) serving as a driving source for rotating the print head 2, a swingable swing gear 20 (see FIG. 4), a plurality of intermediate gears 21 to 24 (see FIG. 4), a cartridge support portion 25 supporting an ink sheet cartridge 50 storing an ink sheet 51 and a top plate 26. The ink sheet cartridge 50 and a paper feed cassette case 70 for storing the papers 60 supplied to the sublimatic printer are detachably mounted on the printer body 90 of the sublimatic printer according to the first embodiment.

Figure 2:
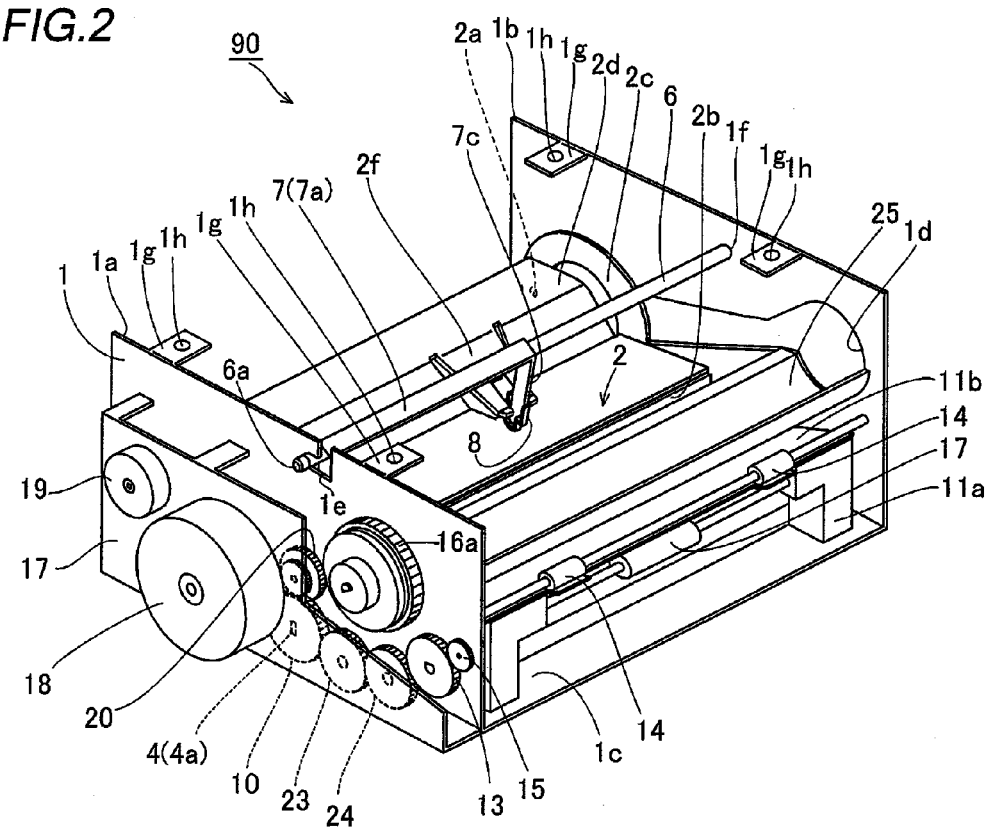
FIG. 2 is a perspective view showing the structure of the sublimatic printer according to the first embodiment shown in FIG. 1.

The chassis 1 has a first side surface 1*a* and a second side surface 1*b* opposed to each other and a bottom surface 1*c*, as shown in FIGS. 1 and 2. The aforementioned motor bracket 17 is mounted on the first side surface 1*a* of the chassis 1, as shown in FIG. 2. The second side surface 1*b* of the chassis 1 opposed to the first side surface 1*a* is provided with a cartridge receiving hole 1*d* for receiving the ink sheet cartridge 50, as shown in FIGS. 1 and 2. The first side surface 1*a* of the chassis 1 is provided with a support portion 1*e* formed by notching a position opposed to a first end 6*a* (see FIG. 2) of the support rod 6 in an L-shaped manner in order to rotatably support the print head rotating member 7 with the support rod 6, as shown in FIGS. 1 and 2. The second side surface 1*b* of the chassis 1 is provided with a support hole 1*f* rotatably receiving a second end 6*b* of the support rod 6 for rotatably supporting the print head rotating member 7 with the support rod 6, as shown in FIGS. 1 and 2.

Figure 6:
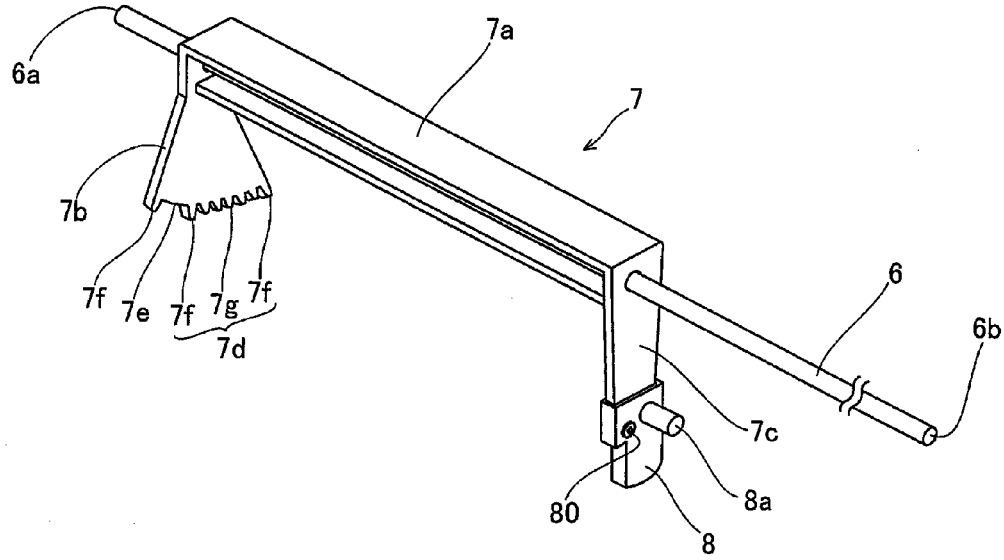
FIG. 6 is a perspective view showing a print head rotating member of the sublimatic printer according to the first embodiment shown in FIG. 1.
Figure 8:
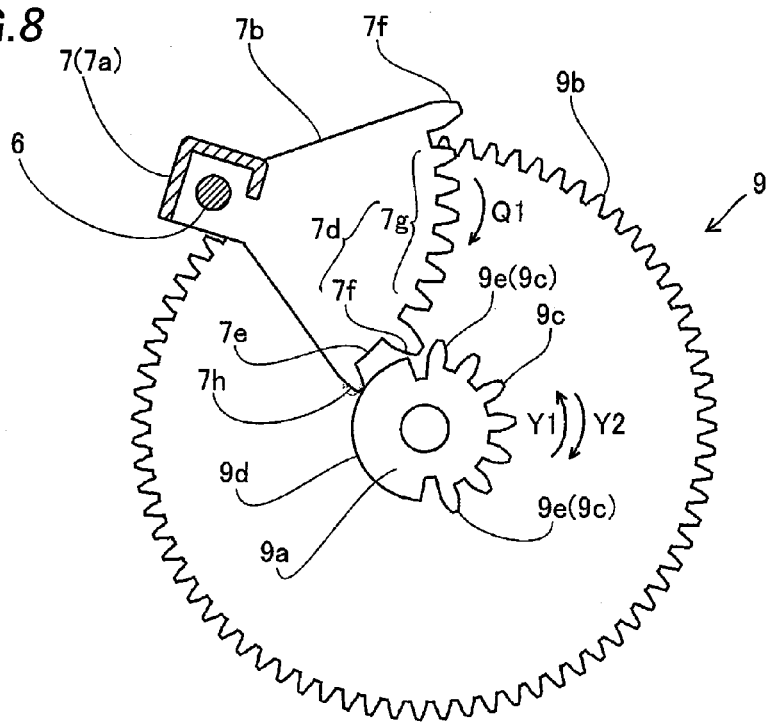
FIG. 8 illustrates a mesh state between a driving gear and a driven gear portion of the print head rotating member in the sublimatic printer according to the first embodiment shown in FIG. 1.

According to the first embodiment, the print head rotating member 7 has a sectorial driven gear portion 7*b* and a pressing portion 7*c* integrally provided on both longitudinal ends of a rotating shaft portion 7*a* formed by folding a sheet metal member in the form of a groove respectively, as shown in FIG. 6. The sectorial driven gear portion 7*b* is provided with (eight) toothed portions 7*d* formed in a prescribed rotation angle range and a toothless portion 7*e* formed on a region other than the toothed portions 7*d*. The toothed portions 7*d* and the toothless portion 7*e* are examples of the "second toothed portion" and the "second toothless portion" in the present invention respectively. Among the toothed portions 7*d* of the driven gear portion 7*b*, two toothed portions 7*f* provided on both ends of the driven gear portion 7*b* are so formed that the tip diameter thereof is larger than that of the (remaining six) toothed portions 7*g* adjacent thereto (the whole depth of the toothed portions 7*f* is higher than that of the toothed portions 7*g*), as shown in FIG. 8. The toothed portions 7*f* and 7*g* are examples of the "third toothed portion" and the "fourth toothed portion" in the present invention respectively.

Figure 5:
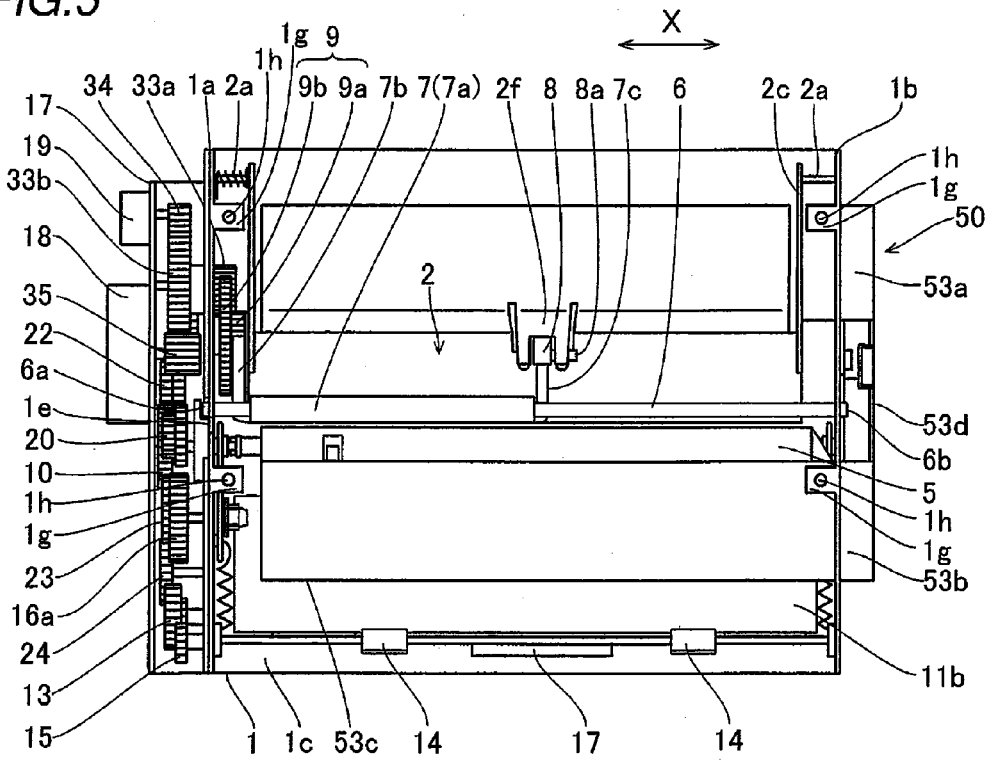
FIG. 5 is a plan view of the sublimatic printer according to the first embodiment shown in FIG. 1.
Figure 7:
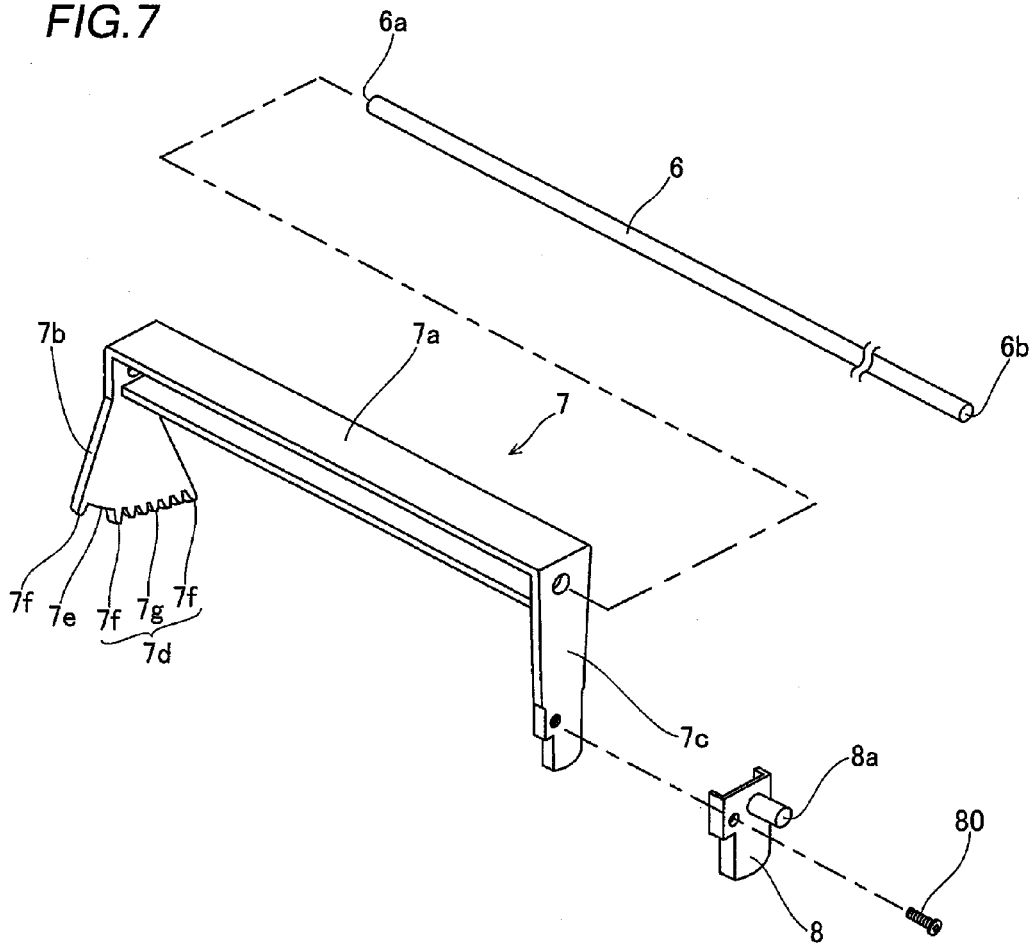
FIG. 7 is an exploded perspective view showing a support rod and the print head rotating member of the sublimatic printer according to the first embodiment shown in FIG. 1.

According to the first embodiment, the print head rotating member 7 is so arranged above the print head 2 that the pressing portion 7*c* thereof presses a substantially central portion of the print head 2 in the cross direction (along arrow X), as shown in FIG. 5. Therefore, the head portion pressing member 8 fixed to the pressing portion 7*c* with a screw 80 is so formed as to press the center of the print head 2 (see FIG. 5) in the cross direction (along arrow X in FIG. 5), as shown in FIG. 7.

As shown in FIG. 1, two pairs of mounting portions 1*g* for mounting the top plate 26 are formed on the upper ends of the first and second side surfaces 1*a* and 1*b* of the chassis 1 respectively. The four mounting portions 1*g* of the chassis 1 are provided with threaded holes 1*h* for fixing the top plate 26 to the chassis 1 with screws 27 inserted into four holes 26*a* provided in the top plate 26 respectively. When the top plate 26 is mounted on the chassis 1, a stop portion 26*b* integrally formed on the top plate 26 by uprighting is inserted into an L-shaped support portion 1*e* provided on the first side surface 1*a* of the chassis 1, so that the support rod 6 and the print head rotating member 7 are rotatably supported on the chassis 1, not to slip off the chassis 1.

As shown in FIG. 1, further, the first and second side surfaces 1*a* and 1*b* of the chassis 1 are provided with support holes 1*i* and 1*j* for rotatably supporting the platen roller 3 (see FIG. 3) and the feed roller 4 (see FIG. 3) respectively. The bottom surface 1*c* of the chassis 1 is provided with paper sensors 28*a* and 28*b* for detecting front and rear ends of each paper 60 in printing respectively, as shown in FIG. 3.

As shown in FIGS. 1 and 5, two platen roller bearings 3*a* are mounted on the support holes 1*i* of the first and second side surfaces 1*a* and 1*b* of the chassis 1 respectively, for rotatably supporting the platen roller 3 (see FIG. 3). The feed roller 4 has a feed roller gear insertion portion 4*a* inserted into the feed roller gear 10, as shown in FIG. 4. This feed roller 4 is rotatably supported by a feed roller bearing (not shown) mounted on the support holes 1*j* of the chassis 1. The press roller 5 (see FIG. 3) is also rotatably supported by a press roller bearing (not shown). The feed roller 4 and the press roller 5 rotate while holding each paper 60 therebetween thereby transporting the paper 60 in a paper feed direction (along arrow T1) or a paper discharge direction (along arrow U1), as shown in FIG. 3. The paper feed roller 12 transports the papers 60 stored in the paper feed cassette case 70 (see FIG. 1) into the chassis 1.

As shown in FIGS. 1 and 3, the print head 2 includes a pair of support shafts 2*a*, a head portion 2*b* opposed to the platen roller 3 (see FIG. 3), a pair of arm portions 2*c* coupling the support shafts 2*a* and the head portion 2*b* with each other, a heat radiating member 2*d* of aluminum for radiating heat from the head portion 2*b* and a paper guide member 2*e* of resin mounted on the head portion 2*b*. This print head 2 is rotatable in the vertical direction (along arrow P1 or P2 in FIG. 3) around the pair of support shafts 2*a* mounted on the inner surfaces of the first and second side surfaces 1*a* and 1*b* of the chassis 1 respectively.

As shown in FIGS. 1 and 5, an engaging portion 2*f* engaging with a protrusion 8*a* (see FIG. 6) integrally formed on the head portion pressing member 8 of resin is integrally formed on the heat radiating member 2*d* of the print head 2. When the head portion pressing member 8 is rotated upward (along arrow Q2), therefore, the protrusion 8*a* thereof engages with the engaging portion 2*f* from under the same for rotating the head portion 2*b* upward (along arrow P2) thereby separating the head portion 2*b* from the platen roller 3, as shown in FIG. 3.

The driving gear 9 and an intermediate gear 33 are so provided as to rotate the head portion pressing member 8 along with the print head rotating member 7 by transmitting the driving force of the stepping motor 19 to the driven gear portion 7*b* of the print head rotating member 7, as shown in FIG. 5. The driving gear 9 is mounted on the inner side the first side surface 1*a* of the chassis 1, as shown in FIG. 5. On the other hand, the intermediate gear 33 and the stepping motor 19 are mounted on the outer side of the first side surface 1*a* of the chassis 1 through the motor bracket 17, as shown in FIG. 5.

Figure 9:
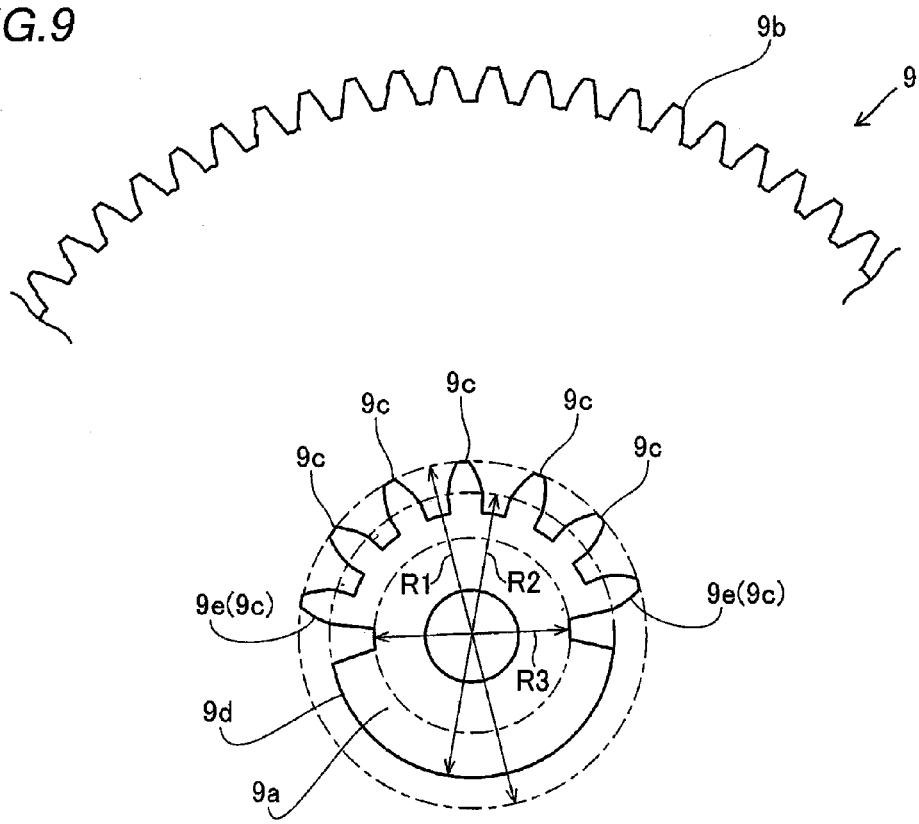
FIG. 9 detailedly illustrates the driving gear of the sublimatic printer according to the first embodiment shown in FIG. 1.

According to the first embodiment, the driving gear 9 is integrally provided with a small-diametral gear portion 9*a* and a large-diametral gear portion 9*b*, as shown in FIGS. 5 and 8. As shown in FIG. 8, the small-diametral gear portion 9*a* is provided with (seven) toothed portions 9*c* formed in the prescribed rotation angle range (about 160°) and a toothless portion 9*d* formed on a region other than the toothed portions 9*c* in the prescribed rotation angle range (about 160°). The small-diametral gear portion 9*a*, the toothed portions 9*c* and the toothless portion 9*d* are examples of the "driving gear", the "first toothed portion" and the "first toothless portion" in the present invention respectively. As shown in FIG. 9, the outer peripheral surface of the toothless portion 9*d* of the small-diametral gear portion 9*a* of the driving gear 9 has a diameter R2 smaller than the tip diameter R1 of the toothed portions 9*c*. The small-diametral gear portion 9*a* is so provided with the seven toothed portions 9*c* as to have eight bottoms adjacent to the toothed portions 9*c* in the same number as the (eight) toothed portions 7*d* of the driven gear portion 7*b* meshing therewith.

The small-diametral gear portion 9*a* of the driving gear 9 meshes with the driven gear portion 7*b* of the print head rotating member 7 while the large-diametral gear portion 9*b* (see FIG. 5) of the driving gear 9 (see FIG. 5) meshes with a small-diametral gear 33*a* (see FIG. 5) of the intermediate gear 33 (see FIG. 5), as shown in FIGS. 5 and 8. A large-diametral gear 33*b* of the intermediate gear 33 meshes with a motor gear 34 of the stepping motor 19, as shown in FIG. 5. Thus, the driving force of the stepping motor 19 is transmitted to the head portion pressing member 8 through the intermediate gear 33, the driving gear 9 and the print head rotating member 7.

When the print head rotating member 7 rotates the print head 2 downward (along arrow P1) for starting a printing operation as shown in FIG. 3 and the driven gear portion 7*b* thereof meshes with the small-diametral gear portion 9*a* of the driving gear 9, one of the toothed portions 7*f* of the driven gear portion 7*b* first meshes with the corresponding toothed portion 9*c* of the driving gear 9, as shown in FIG. 8. At this time, the root diameter R3 (see FIG. 9) of toothed portions 9*e* (two of the toothed portions 9*c* provided on both ends of the small-diametral gear portion 9*a*), included in the toothed portions 9*c* of the small-diametral gear portion 9*a*, meshing with the toothed portions 7*f* (see FIG. 8) of the driven gear portion 7*b* is smaller than the diameter R2 (see FIG. 9) of the outer peripheral surface of the toothless portion 9*d*, as shown in FIGS. 8 and 9.

Figure 10:
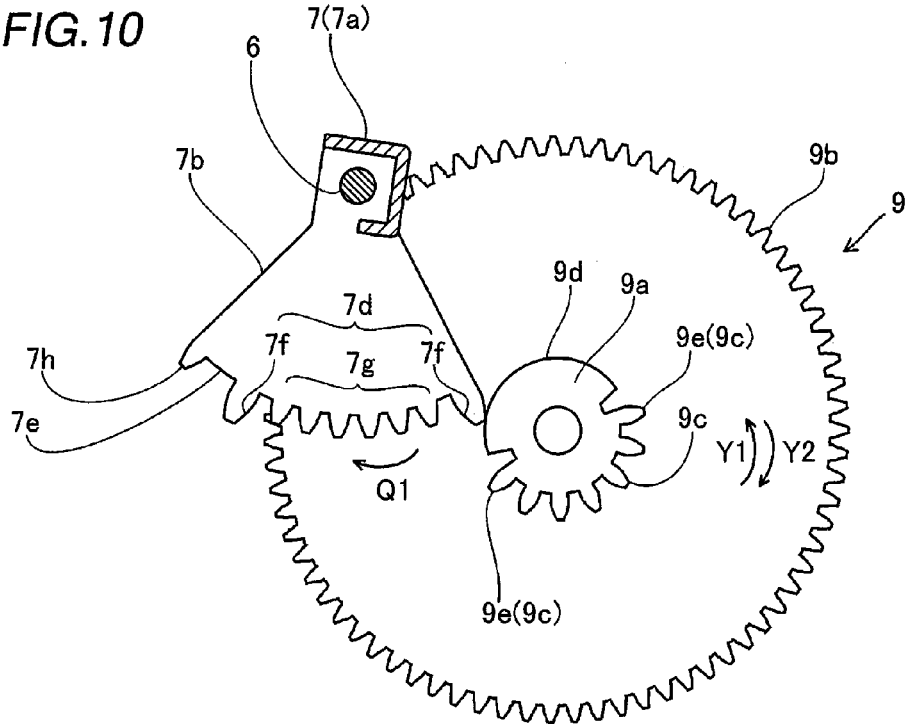
FIGS. 10 and 11 illustrate mesh states between the driving gear and the driven gear portion of the print head rotating member in the sublimatic printer according to the first embodiment shown in FIG. 1 respectively.

When the head portion pressing member 8 so presses the print head 2 that the print head 2 presses the platen roller 3 (see FIG. 3) with the prescribed pressing force in starting of printing as shown in FIGS. 2 and 3, the toothless portion 9*d* of the small-diametral gear portion 9*a* of the driving gear 9 slides on the side surface of one of the toothed portions 7*f* of the driven gear portion 7*b* of the print head rotating member 7, as shown in FIG. 10. During the printing, therefore, the print head rotating member 7 is kept on the same rotational position regardless of the rotation angle of the driving gear 9, whereby the pressing force of the print head 2 for the platen roller 3 can be kept constant.

Figure 11:
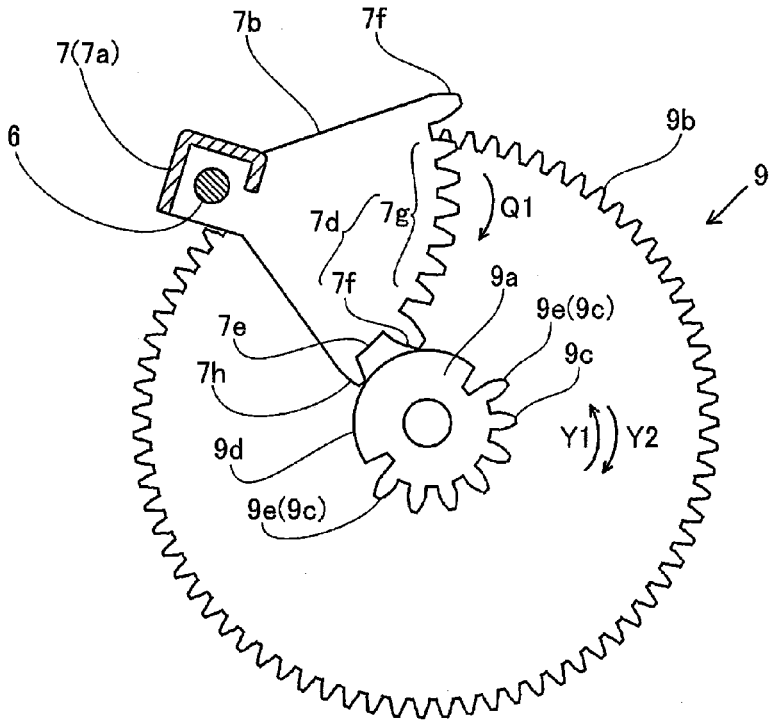

According to the first embodiment, the driven gear portion 7*b* has a toothed portion 7*h* provided on a region of the driven gear portion 7*b* other than the toothed portions 7*d* and the toothless portion 7*e*, as shown in FIG. 8. The toothed portion 7*h* is an example of the "fifth toothed portion" in the present invention. When the print head 2 (see FIG. 3) is most separated from the platen roller 3 (see FIG. 3) upward (along arrow P2 in FIG. 3) and the small-diametral gear portion 9*a* of the driving gear 9 and the toothed portions 7*d* of the print head rotating member 7 are out of mesh in nonprinting, one of the toothed portions 7*f* and the toothed portion 7*h* of the driven gear portion 7*b* hold the small-diametral gear portion 9*a* of the driving gear 9 over the toothless portion 9*d* of the driving gear 9, as shown in FIG. 11. In this case, the side surfaces of one of the toothed portions 7*f* and the toothed portion 7*h* of the driven gear portion 7*b* slidably come into contact with the toothless portion 9*d* of the small-diametral gear portion 9*a* of the driving gear 9 thereby holding the small-diametral gear portion 9*a* of the driving gear 9, as shown in FIG. 11.

A motor gear 35 is mounted on the shaft portion of the stepping motor 18 mounted on the motor bracket 17, as shown in FIG. 4. The stepping motor 18 functions as a driving source for driving a gear portion 16*a* of the take-up reel 16, the paper feed roller gear 13, the paper discharge roller gear 15 and the feed roller gear 10, as shown in FIGS. 4 and 5.

The take-up reel 16 engages with a take-up bobbin 52*b* arranged in a take-up bobbin storage portion 53*b* of the ink sheet cartridge 50 described later, thereby taking up the ink sheet 51 wound on the take-up bobbin 52. The gear portion 16*a* of the take-up reel 16 is so arranged as to mesh with the swing gear 20 upon swinging thereof, as shown in FIG. 4.

The lower paper guide 11*a* is set in the vicinity of the feed roller 4 and the press roller 5, as shown in FIG. 3. The upper paper guide 11*b* is mounted on the upper portion of the lower paper guide 11*a*. The upper paper guide 11*b* guides each paper 60 to a paper feed path to a printing portion through the lower surface thereof in paper feeding, and guides the paper 60 to a paper discharge path through the upper surface thereof in paper discharge.

As shown in FIG. 1, the ink sheet cartridge 50 includes a supply bobbin 52*a* for supplying the ink sheet 51 and the take-up bobbin 52*b* for taking up the supplied ink sheet 51. A cartridge case 53 constituting the ink sheet cartridge 50 is constituted of a supply bobbin storage portion 53*a* rotatably storing the supply bobbin 52*a*, the take-up bobbin storage portion 53*b* rotatably storing the take-up bobbin 52*b* and a pair of coupling portions 53*c* and 53*d* coupling the supply bobbin storage portion 53*a* and the take-up bobbin storage portion 53*b* with each other at a prescribed distance. When the supply bobbin storage portion 53*a* and the take-up bobbin storage portion 53*b* store the supply bobbin 52*a* and the take-up bobbin 52*b* respectively, therefore, the ink sheet 51 wound on the supply bobbin 52*a* and the take-up bobbin 52*b* is exposed on the space of the prescribed distance between the supply bobbin storage portion 53*a* and the take-up bobbin storage portion 53*b*. The ink sheet 51 is formed by successively linking ink sheets of three colors, i.e., Y (yellow), M (magenta) and C (cyan), with each other.

The printing operation of the sublimatic printer according to the first embodiment is now described with reference to FIGS. 1, 3 to 6, 8 and 10 to 16.

Figure 12:
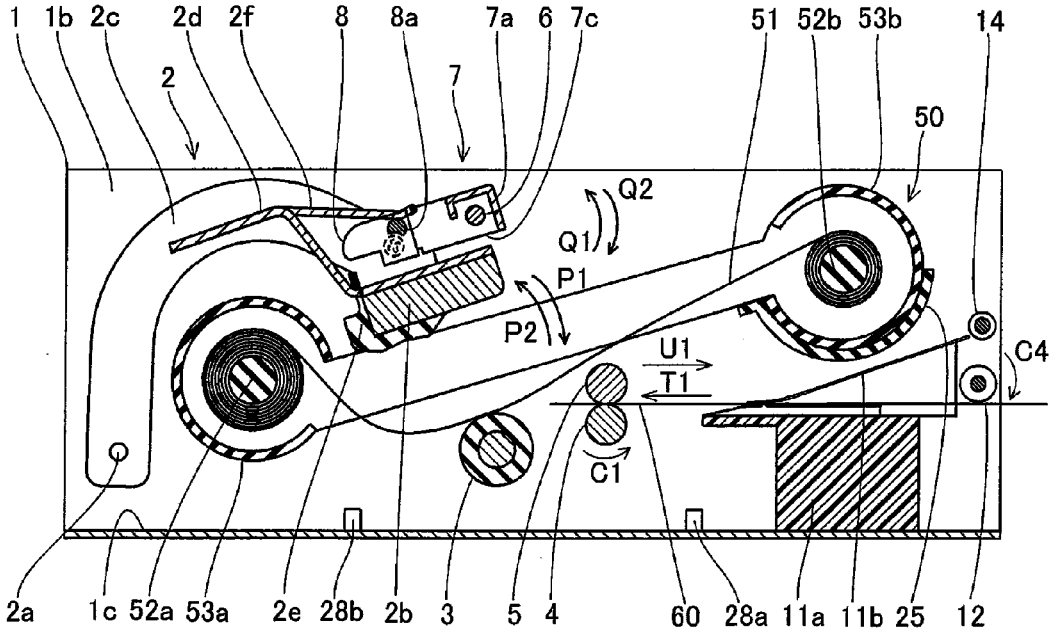
FIGS. 12 and 13 are diagrams for illustrating a printing operation of the sublimatic printer according to the first embodiment shown in FIG. 1.

Before power is applied to the printer body 90 for starting the printing operation (printing standby state), the head portion 2*b* of the print head 2 is kept on a position upwardly separated from the platen roller 3, as shown in FIG. 12. In this case, the protrusion 8*a* of the head portion pressing member 8 mounted on the print head rotating member 7 upwardly engages with the engaging portion 2*f* of the head portion 2*b* thereby inhibiting the head portion 2*b* from rotation along arrow P1, as shown in FIG. 12.

According to the first embodiment, the small-diametral gear portion 9*a* of the driving gear 9 and the driven gear portion 7*b* are arranged as shown in FIG. 1 when the print head rotating member 7 is located on a rotational position (at a rotation angle) in the printing standby state. In other words, the side surfaces of one of the toothed portions 7*f* and the toothed portion 7*h* of the driven gear portion 7*b* slidably come into contact with the toothless portion 9*d* of the small-diametral gear portion 9*a* of the driving gear 9 over the toothless portion 9*d* of the small-diametral portion 9*a* of the driving gear 9 thereby holding the small-diametral gear portion 9*a* of the driving gear 9 when the small-diametral gear portion 9*a* of the driving gear 9 and the toothed portions 7*d* of the driven gear portion 7*b* of the print head rotating member 7 are out of mesh.

Figure 13:
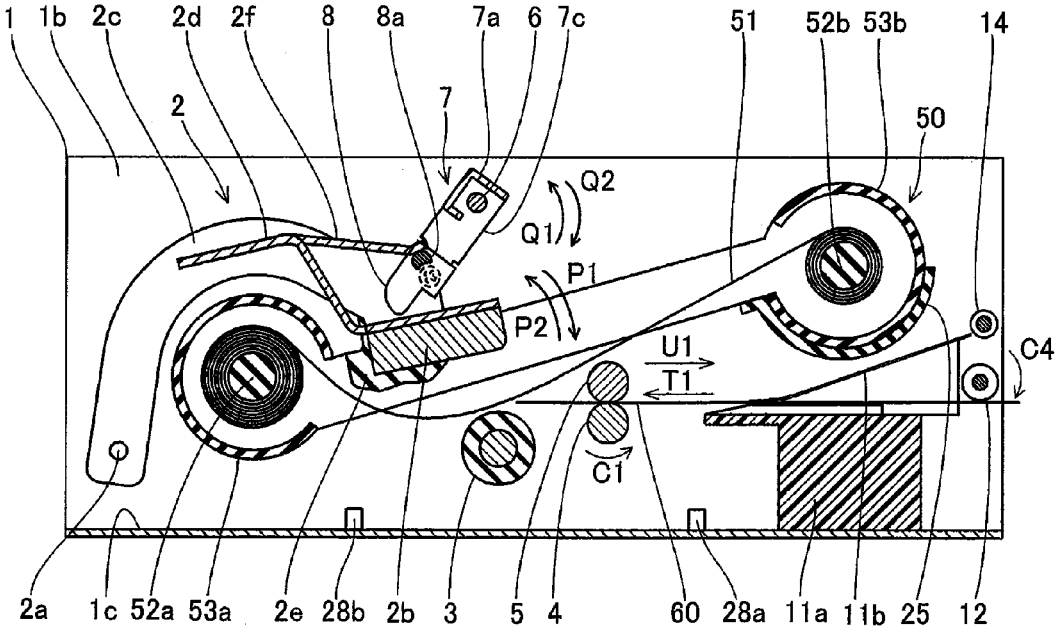

When a print button (not shown) is pressed to start the printing operation, the stepping motor 19 (see FIG. 5) is so driven from the initial state (printing standby state) shown in FIG. 12 that the driving force thereof is transmitted to the toothed portions 7*d* (see FIG. 1) of the print head rotating member 7 through the motor gear 34 (see FIG. 5), the large-diametral gear 33*b* (see FIG. 5) and the small-diametral gear 33*a* (see FIG. 5) of the intermediate gear 33 (see FIG. 5) and the large-diametral gear portion 9*b* and the small-diametral gear portion 9*a* of the driving gear 9 (see FIG. 5) thereby rotating the print head rotating member 7 around the support rod 6 thereof along arrow Q1, as shown in FIG. 13. At this time, the head portion pressing member 8 (see FIG. 6) mounted on the print head rotating member 7 is also rotated along arrow Q1 with the print head rotating member 7. The protrusion 8*a* of the head portion pressing member 8 is rotated along arrow Q1 thereby rotating the head portion 2*b*, having been inhibited from rotation along arrow P1, along arrow P1, as shown in FIG. 13. Thus, the head portion 2*b* gradually starts lowering from the separated position, to move toward the platen roller 3 (pressing side).

Figure 14:
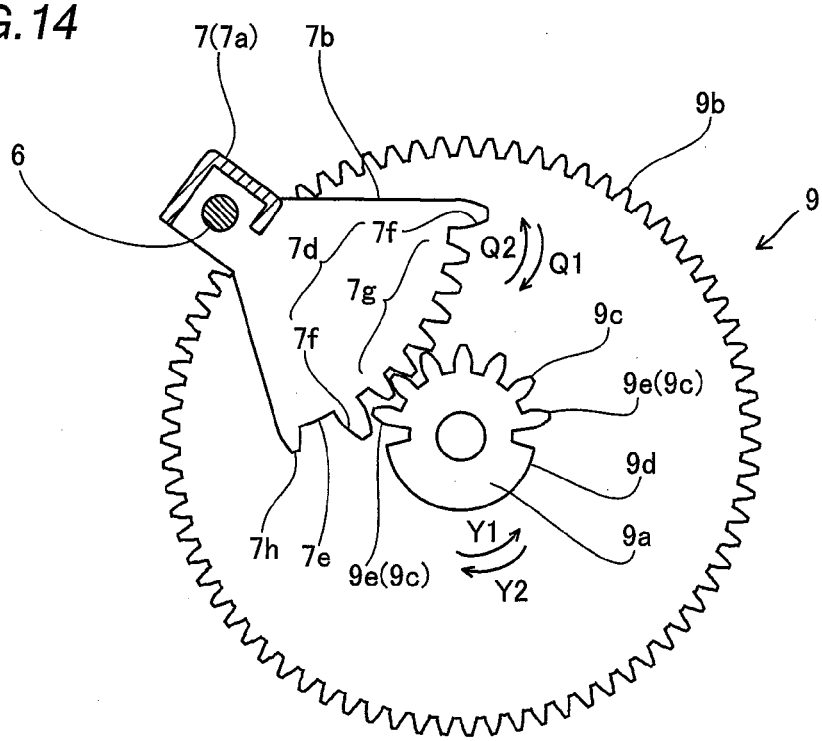
FIG. 14 is a diagram for illustrating a mesh state between the driving gear and the driven gear portion of the print head rotating member in the printing operation of the sublimatic printer according to the first embodiment shown in FIG. 1.

According to the first embodiment, one of the toothed portions 7*f* of the driven gear portion 7*b* first starts meshing with the corresponding one of the toothed portions 9*c* (more strictly, the corresponding one of the toothed portions 9*e* included in the toothed portions 9*c*) of the driving gear 9 when the stepping motor 19 (see FIG. 5) rotates the driving gear 9 along arrow Y1 by about 62° from the initial position (rotational position in the printing standby state), as shown in FIG. 8. Then, the toothed portions 9*c* of the driving gear 9 successively mesh with the toothed portions 7*g* of the driven gear portion 7*b* along arrow Y1 thereby rotating the print head rotating member 7 along arrow Q1 (see FIG. 13), as shown in FIG. 14.

As shown in FIG. 3, the driving gear 9 (see FIG. 11) is rotated along arrow Y1 (see FIG. 11) by about 165° from the initial position (see FIG. 11), thereby rotating the print head 2 along arrow P1 to a printing standby position (paper feed standby position).

Following this rotation of the print head 2 to the printing standby position (paper feed standby position), each paper 60 is transported (fed) toward the printing start position, and the paper sensors 28*a* and 28*b* for detecting the front and rear ends of the paper 60 sense the paper 60, as shown in FIG. 3. In paper feeding, the stepping motor 18 is so driven as to rotate the motor gear 35 mounted thereon along arrow C3 and to rotate the feed roller gear 10 along arrow C1 through the intermediate gears 21 and 22, as shown in FIG. 4. Thus, the feed roller 4 is rotated along arrow C1. Further, the paper feed roller gear 13 and the paper feed roller 12 are rotated along arrow C4 through the intermediate gears 23 and 24. Thus, the paper 60 (see FIG. 3) is transported in the paper feed direction (along arrow T1 in FIG. 3). At this time, the swingable swing gear 20 (see FIG. 4) and the gear 16*a* of the take-up reel 16 are out of mesh, and the gear 16*a* of the take-up reel 16 remains unrotated. In paper feeding, therefore, the ink sheet 51 wound on the supply bobbin 52*a* (see FIG. 1) is not taken up on the take-up bobbin 52*b*.

Figure 15:
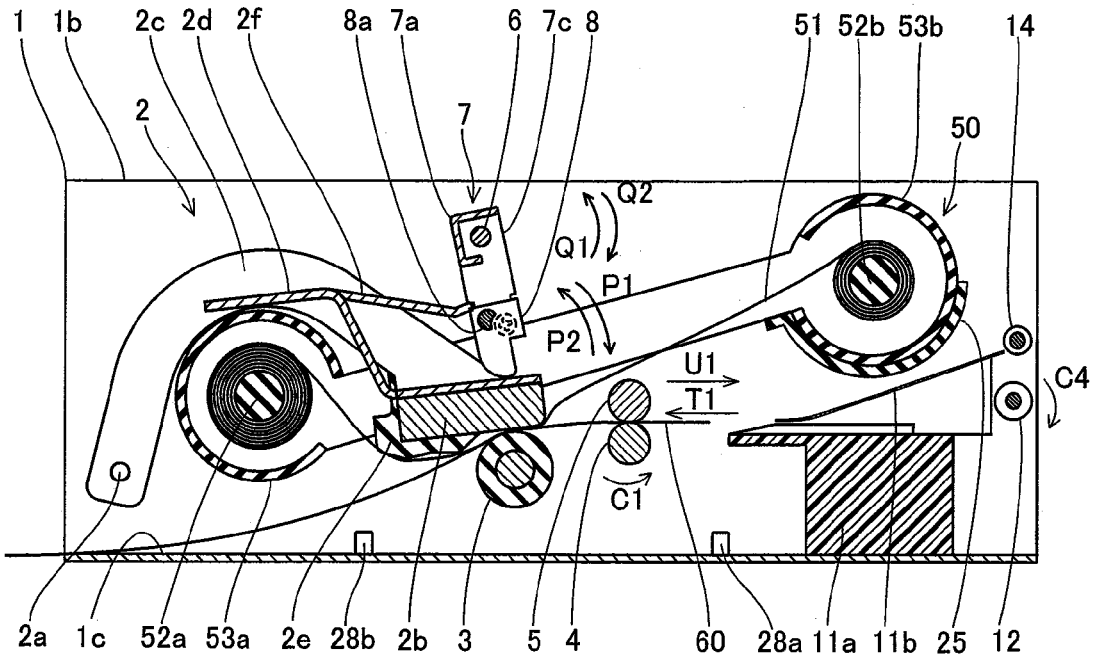
FIG. 15 is a diagram for illustrating the printing operation of the sublimatic printer according to the first embodiment shown in FIG. 1.

When the paper sensors 28*a* and 28*b* completely sense the paper 60, the print head rotating member 7 is further rotated along arrow Q1 by a prescribed angle thereby rotating the protrusion 8*a* of the head portion pressing member 8 along arrow Q1 and disengaging the same from the engaging portion 2*f*, as shown in FIG. 15.

In the state where the print head 2 moves to the pressing position for the platen roller 3 as shown in FIG. 15, the print head rotating member 7 is further rotated along arrow Q1. Thus, the head portion pressing member 8 presses the print head 2, as shown in FIG. 15. In this case, the driving gear 9 is rotated along arrow Y1 by about 330° from the initial position (see FIG. 11), as shown in FIG. 10.

According to the first embodiment, the toothless portion 9*d* of the small-diametral gear portion 9*a* of the driving gear 9 slides on the side surface of one of the toothed portions 7*f* of the driven gear portion 7*b* of the print head rotating member 7, as shown in FIG. 10. Therefore, the print head rotating member 7 is kept on the same rotational position regardless of the rotation angle of the driving gear 9, even if the driving gear 9 is rotated along arrow Y1 in excess of about 330° from the initial position (see FIG. 11). Thus, the print head 2 holds the ink sheet 51 (Y ink sheet) and the paper 60 and presses the platen roller 3 while keeping the pressing force (pressurizing force) for the platen roller 3 constant. The head portion 2*b* of the print head 2 so generates heat as to melt/sublimate the ink of the ink sheet 51 (Y ink sheet) and transfer the same to the paper 60.

Figure 16:
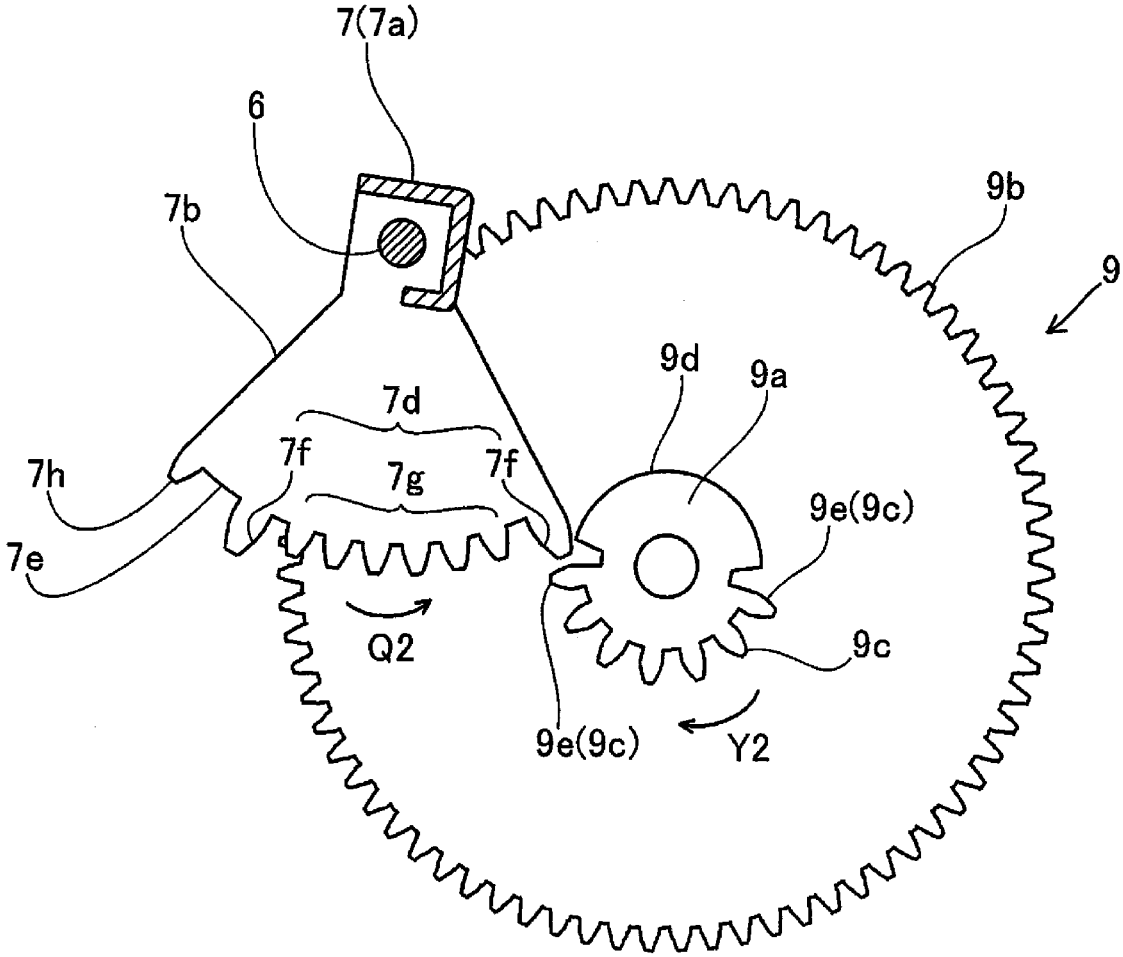
FIG. 16 is a diagram for illustrating another mesh state between the driving gear and the driven gear portion of the print head rotating member in the printing operation of the sublimatic printer according to the first embodiment shown in FIG. 1.

At this time, the stepping motor 18 is so driven as to rotate the motor gear 35 mounted thereon along arrow D3 and to rotate the feed roller gear 10 along arrow D1 through the intermediate gears 21 and 22, as shown in FIG. 4. Following this rotation of the feed roller gear 10 (see FIG. 4), the feed roller 4 is rotated along arrow D1 in FIG. 4 thereby transporting the paper 60 printed with the transferred ink in the paper discharge direction (along arrow U1), as shown in FIG. 16. The swingable swing gear 20 swings in the direction (along arrow D2) for meshing with the gear portion 16*a* of the take-up reel 16 thereby meshing with the gear portion 16*a* of the take-up reel 16, as shown in FIG. 4. Therefore, the gear portion 16*a* of the take-up reel 16 is rotated along arrow D4, thereby taking up the ink sheet 51 wound on the supply bobbin 52*a* (see FIG. 16) on the take-up bobbin 52*b*. Thus, the paper 60 is transported in the paper discharge direction (along arrow U1) so that the ink is continuously transferred thereto from the ink sheet 51 (Y ink sheet), as shown in FIG. 16.

When printing with the Y (yellow) ink sheet is terminated, the stepping motor 19 (see FIG. 4) is so driven that the driving force thereof is transmitted to the driven gear portion 7*b* (see FIG. 1) of the print head rotating member 7 through the intermediate gear 33 (see FIG. 5) and the driving gear 9 (see FIG. 5). Then, the print head rotating member 7 (see FIG. 1) is rotated around the support rod 6 along arrow Q2, as shown in FIG. 15.

When the stepping motor 19 (see FIG. 5) rotates the driving gear 9 in the reverse direction (along arrow Y2) from the state shown in FIG. 10, the other one of the toothed portions 7*f* of the driven gear portion 7*b* first starts meshing with the corresponding one of the toothed portions 9*c* (more strictly, the corresponding one of the toothed portions 9*e* included in the toothed portions 9*c*) of the driving gear 9, as shown in FIG. 16. Then, the toothed portions 9*c* of the driving gear 9 successively mesh with the toothed portions 7*g* of the driven gear portion 7*b* along arrow Y2 thereby rotating the print head rotating member 7 along arrow Q2 (see FIG. 3), as shown in FIG. 14.

At this time, the head portion pressing member 8 (see FIG. 6) mounted on the print head rotating member 7 is also rotated along arrow Q2 with the print head rotating member 7. As shown in FIG. 3, the protrusion 8*a* of the head portion pressing member 8 is also rotated along arrow Q2, thereby pushing up the engaging portion 2*f* of the print head 2 engaging therewith and rotating the head portion 2*b* of the print head 2 along arrow P2. Thus, the head portion 2*b* of the print head 2 is separated from the platen roller 3.

As shown in FIG. 4, the stepping motor 18 is so driven as to rotate the motor gear 35 mounted thereon along arrow C3 and to rotate the feed roller gear 10 along arrow C1 through the intermediate gears 21 and 22. Following this rotation of the feed roller gear 10 (see FIG. 3), the feed roller 4 is rotated along arrow C1, whereby the paper 60 is transported in the paper feed direction (along arrow T1) again and the paper sensors 28*a* and 28*b* sense the paper 60 again, as shown in FIG. 3. The swingable swing gear 20 (see FIG. 4) swings in a direction (along arrow C2 in FIG. 4) for separating from the gear portion 16*a* of the take-up reel 16 (see FIG. 4). Thus, the ink sheet 51 wound on the supply bobbin 52*a* is not taken up on the take-up bobbin 52*b* but only the paper 60 is transported in the paper feed direction.

Thereafter operations similar to the aforementioned printing operation described with reference to FIGS. 3 and 15 are repeated as to the M and C ink sheets respectively. When printing with all inks of the ink sheet 51 is terminated, the paper 60 is transported in the paper discharge direction (along arrow U1 in FIG. 3). The head portion 2*b* of the print head 2 is rotated along arrow P2 to the separated position of the initial state (printing standby state) thereby terminating printing on the paper 60, as shown in FIG. 12.

According to the first embodiment, as hereinabove described, the sublimatic printer comprises the print head rotating member 7 integrally including the driven gear portion 7*b* meshing with the small-diametral gear portion 9*a* and the pressing portion 7*c* pressing the print head 2 so that the driven gear portion 7*b* and the pressing portion 7*c* may not be provided independently of the print head rotating member 7, whereby increase in the number of components forming the printer body 90 can be suppressed.

According to the first embodiment, the small-diametral gear portion 9*a* is so arranged that the toothless portion 9*d* thereof slides on one of the toothed portions 7*d* of the driven gear portion 7*d* of the print head rotating member 7 in the vicinity of the position (see FIG. 15) where the print head 2 presses the platen roller 3 with the pressing portion 7*c* of the print head rotating member 7 so that the toothless portion 9*d* of the small-diametral gear portion 9*a* is slidably in contact with one of the toothed portions 7*d* (more strictly, one of the toothed portions 7*f*) of the driven gear portion 7*d* of the print head rotating member 7 in the vicinity of the position where the print head 2 presses the platen roller 3 with the pressing portion 7*c* of the print head rotating member 7, whereby the rotational position of the print head rotating member 7 is inhibited from changing even if the rotation angle of the small-diametral gear portion 9*a* is dispersed. Consequently, the pressing portion 7*c* of the print head rotating member 7 can apply constant pressing force to the print head 2.

According to the first embodiment, the diameter R2 (see FIG. 9) of the outer peripheral surface of the toothless portion 9*d* of the small-diametral gear portion 9*a* is smaller than the tip diameter R1 (see FIG. 9) of the toothed portions 9*c* of the small-diametral gear portion 9*a* so that one of the toothed portions 7*d* (more strictly, one of the toothed portions 7*f*) of the driven gear portion 7*d* of the print head rotating member 7 slides on the toothless portion 9*d* having the diameter R2

(see FIG. 9) smaller than the tip diameter R1 (see FIG. 9) of the toothed portions 9*c* of the small-diametral gear portion 9*a*, whereby the circumferential sliding length of the toothless portion 9*d* resulting from dispersion in the rotation angle of the small-diametral gear portion 9*a* can be reduced. Therefore, the toothless portion 9*d* of the small-diametral gear portion 9*a* and the toothed portions 7*d* (7*f*) of the driven gear portion 7*b* can be inhibited from wear resulting from sliding.

According to the first embodiment, the toothed portions 7*d* of the driven gear portion 7*b* are constituted of the (two) toothed portions 7*f* and the (six) toothed portions 7*g* provided in the prescribed rotation angle range while the tip diameter of the toothed portions 7*f* is larger than that of the toothed portions 7*g* and the outermost ones of the toothed portions 7*g* are arranged adjacently to the toothed portions 7*f* respectively so that one of the toothed portions 9*c* (more strictly, one of the toothed portions 9*e*) of the small-diametral gear portion 9*a* and the corresponding toothed portion 7*f* of the driven gear portion 7*b* first mesh with each other when the small-diametral portion 9*a* and the driven gear portion 7*b* of the print head rotating member 7 mesh with each other. When the small-diametral gear portion 9*a* and the driven gear portion 7*b* of the print head rotating member 7 start meshing with each other, therefore, one of the toothed portions 7*f* of the driven gear portion 7*b* having the larger tip diameter first meshes with the corresponding toothed portion 9*c* (9*e*) of the small-diametral portion 9*a*, whereby the small-diametral portion 9*a* can reliably mesh with the driven gear portion 7*b*.

According to the first embodiment, the root diameter R3 (see FIG. 9) of the toothed portions 9*e*, included in the toothed portions 9*c* of the small-diametral gear portion 9*a*, meshing with the toothed portions 7*f* of the driven gear portion 7*b* is smaller than the diameter R2 (see FIG. 9) of the outer peripheral surface of the toothless portion 9*d* so that the tip (addendum) of one of the toothed portions 7*f* of the driven gear portion 7*b* is inhibited from interfering with the bottom of the corresponding toothed portion 9*c* (more strictly, the connected portion between the corresponding toothed portion 9*e* and the toothless portion 9*d*) when the small-diametral gear portion 9*a* starts meshing with the driven gear portion 7*b*, due to the root diameter R3 (see FIG. 9), smaller than the diameter R2 (see FIG. 9) of the outer peripheral surface of the toothless portion 9*d*, of the toothed portions 9*c* of the small-diametral gear portion 9*a* meshing with the toothed portions 7*f* of the driven gear portion 7*b*. Therefore, the small-diametral gear portion 9*a* and the driven gear portion 7*b* can smoothly mesh with each other.

According to the first embodiment, the driven gear portion 7*b* has the toothed portions 7*h* provided on the regions thereof other than the toothed portions 7*d* and the toothless portion 7*e* so that one of the toothed portions 7*f* and the toothed portion 7*h* thereof hold the small-diametral gear portion 9*a* over the toothless portion 9*d* of the small-diametral portion 9*a* when the toothed portions 9*c* of the small-diametral gear portion 9*a* and the toothed portions 7*d* of the driven gear portion 7*b* of the print head rotating member 7 are out of mesh. Thus, the driven gear portion 7*b* can come into contact with the toothless portion 9*d* of the small-diametral gear portion 9*a* through one of the toothed portions 7*f* and the toothed portion 7*h*, whereby the driven gear portion 7*b* can reliably hold the rotational position with respect to the toothless portion 9*d* of the small-diametral gear portion 9*a* through one of the toothed portions 7*f* and the toothed portion 7*h*.

According to the first embodiment, the pressing portion 7*c* of the print head rotating member 7 is so arranged as to press the portion around the cross-directional center of the print head 2, whereby the pressing portion 7*c* of the print head rotating member 7 can press the print head 2 with pressing force horizontally uniform with respect to the cross direction (along arrow X in FIG. 5) of the print head 2. Thus, the print head 2 can uniformly come into contact with the platen roller 3.

According to the first embodiment, the small-diametral gear portion 9*a* is so provided that the toothless portion 9*d* thereof slides on the side surface of one of the toothed portions 7*f* of the driven gear portion 7*b* in the vicinity of the position where the print head 2 presses the platen roller 3 with the head portion pressing member 8 of the print head rotating member 7, whereby the driven gear portion 7*b* can so easily slide that the rotational position of the print head rotating member 7 can be easily inhibited from changing in printing.

Second Embodiment

The structure of a printer body 100 of a sublimatic printer according to a second embodiment of the present invention is now described with reference to FIGS. 17 to 25. In the printer body 100 of the sublimatic printer according to the second embodiment, a print head rotating member 101 is made of not sheet metal but resin, dissimilarly to the printer body 90 of the sublimatic printer according to the aforementioned first embodiment.

Figure 17:
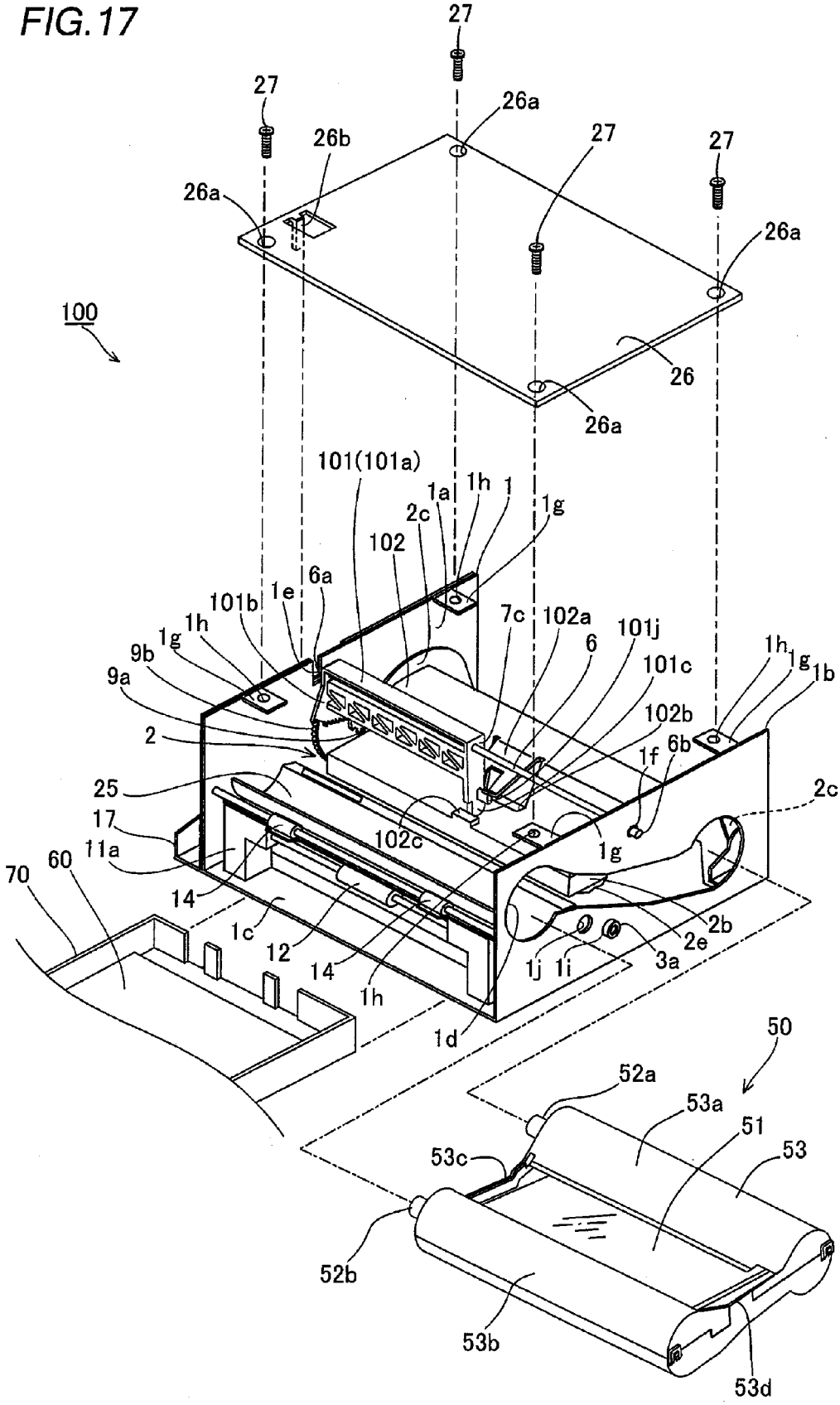
FIG. 17 is an exploded perspective view showing the overall structure of a sublimatic printer according to a second embodiment of the present invention.

The printer body 100 of the sublimatic printer according to the second embodiment comprises the print head rotating member 101 of resin pressing a print head 2, as shown in FIG. 17.

The print head 2 includes a heat radiating member 102 of aluminum for radiating heat from a head portion 2*b*, as shown in FIG. 17.

Figure 18:
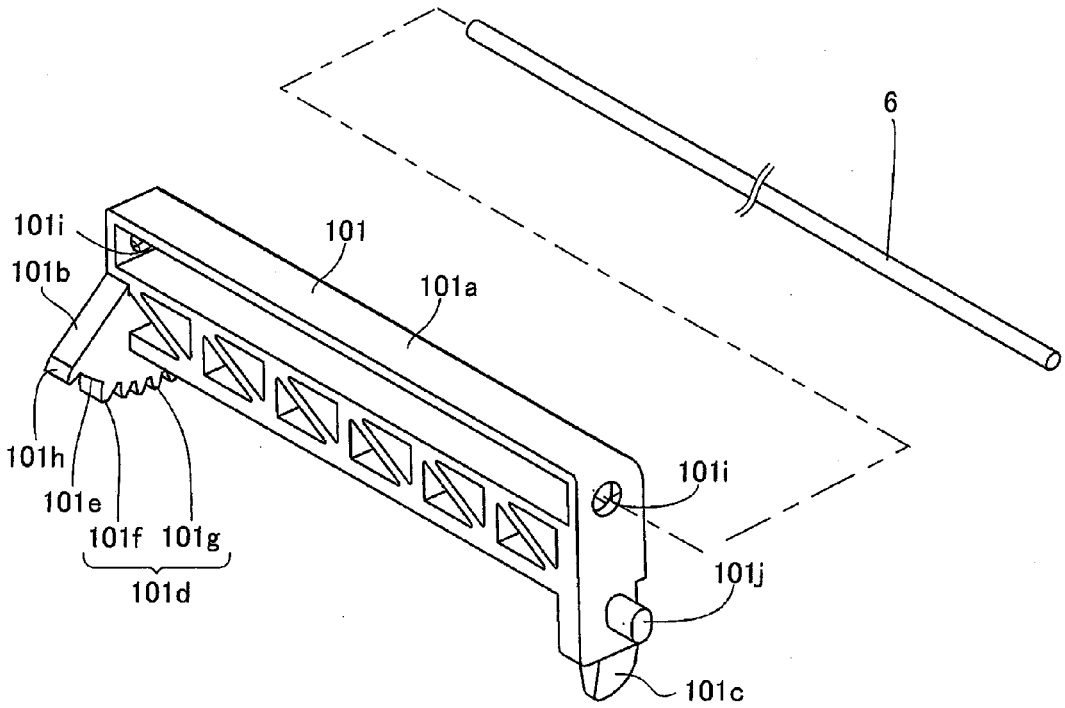
FIG. 18 is a diagram for illustrating a print head rotating member in the sublimatic printer according to the second embodiment shown in FIG. 17.
Figure 19:
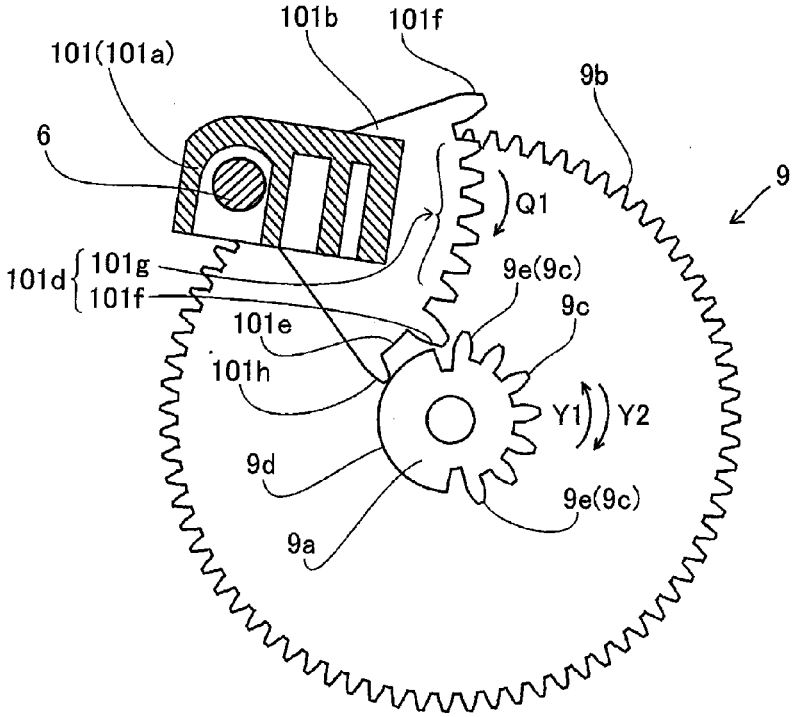
FIG. 19 illustrates a mesh state between a driving gear and a driven gear portion of the print head rotating member in the sublimatic printer according to the second embodiment shown in FIG. 17.

According to the second embodiment, the print head rotating member 101 has a sectorial driven gear portion 101*b* and a pressing portion 101*c* integrally provided on both longitudinal ends of a body portion 101*a* respectively, as shown in FIG. 18. The sectorial driven gear portion 101*b* is provided with (eight) toothed portions 101*d* formed in a prescribed rotation angle range and a toothless portion 101*e* formed on a region other than the toothed portions 101*d*. The print head rotating member 101 is rotated by driving force of a stepping motor 19 transmitted to the driven gear portion 101*b* through a driving gear 9. The toothed portions 101*d* and the toothless portion 101*e* are examples of the "second toothed portion" and the "second toothless portion" in the present invention respectively. Among the toothed portions 101*d* of the driven gear portion 101*b*, two toothed portions 101*f* provided on both ends of the driven gear portion 101*b* are so formed that the tip diameter thereof is larger than that of the (remaining six) toothed portions 101*g* adjacent thereto (the whole depth of the toothed portions 101*f* is higher than that of the toothed portions 101*g*), as shown in FIG. 19. The toothed portions 101*f* and 101*g* are examples of the "third toothed portion" and the "fourth toothed portion" in the present invention respectively.

According to the second embodiment, the print head rotating member 101 is so arranged above the print head 2 that the pressing portion 101*c* presses a substantially central portion of the print head 2 in the cross direction.

When the print head rotating member 101 rotates the print head 2 downward (along arrow P1 in FIG. 20) for starting a printing operation and a small-diametral gear portion 9*a* of the driving gear 9 and the driven gear portion 101*b* of the print head rotating member 101 mesh with each other, one of the toothed portions 101*f* of the driven gear portion 101*b* first meshes with the corresponding toothed portion 9*c* of the driven gear 9, as shown in FIG. 19.

Figure 20:
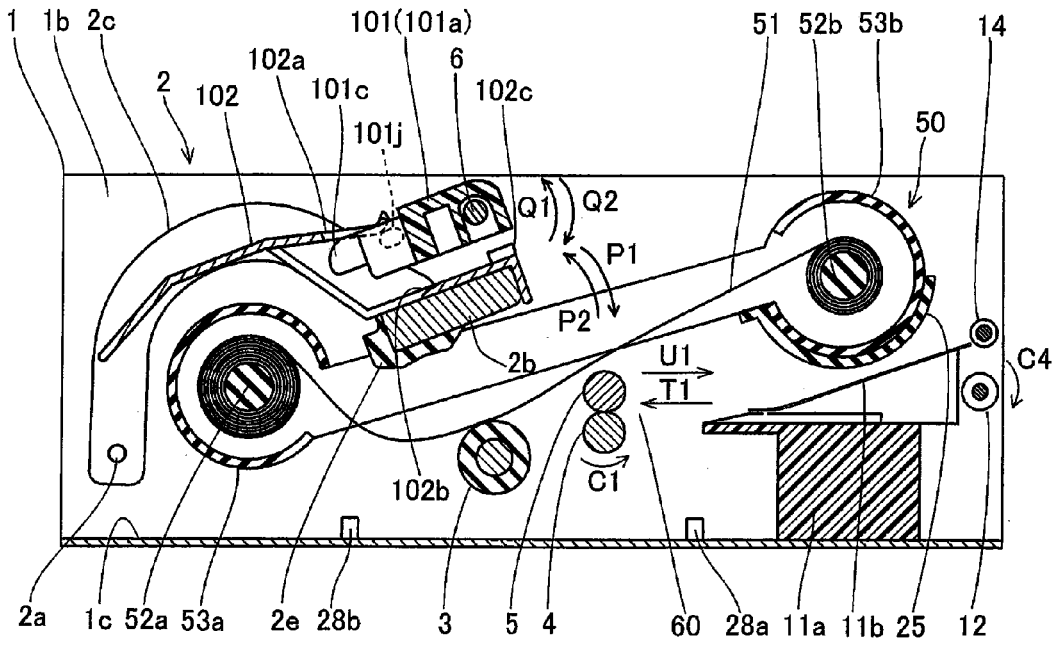
FIG. 20 is a sectional view showing the internal structure of the sublimatic printer according to the second embodiment shown in FIG. 17.
Figure 21:
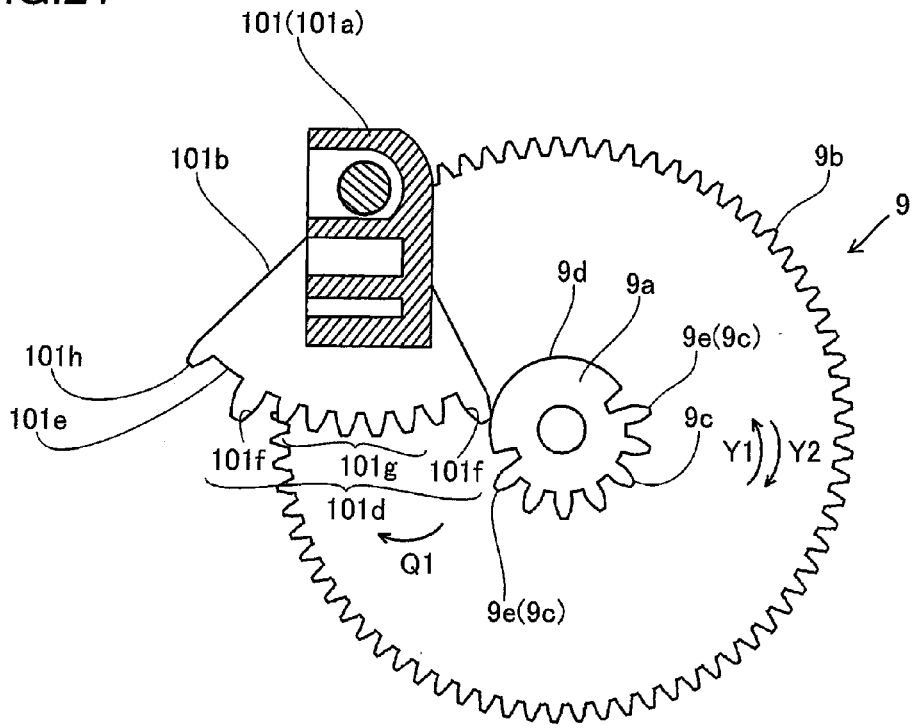
FIGS. 21 and 22 illustrate mesh states between the driving gear and the driven gear portion of the print head rotating member in the sublimatic printer according to the second embodiment shown in FIG. 17.

When the pressing portion 101*c* so presses the print head 2 that the print head 2 presses a platen roller 3 (see FIG. 20) with prescribed pressing force in starting of printing, a toothless portion 9*d* of the small-diametral gear portion 9*a* of the driving gear 9 slides on the side surface of one of the toothed portions 101*f* of the driven gear portion 101*b* of the print head rotating member 101, as shown in FIG. 21. During the printing, therefore, the print head rotating member 101 is kept on the same rotational position regardless of the rotation angle of the driving gear 9, whereby the pressing force of the print head 2 for the platen roller 3 can be kept constant.

Figure 22:
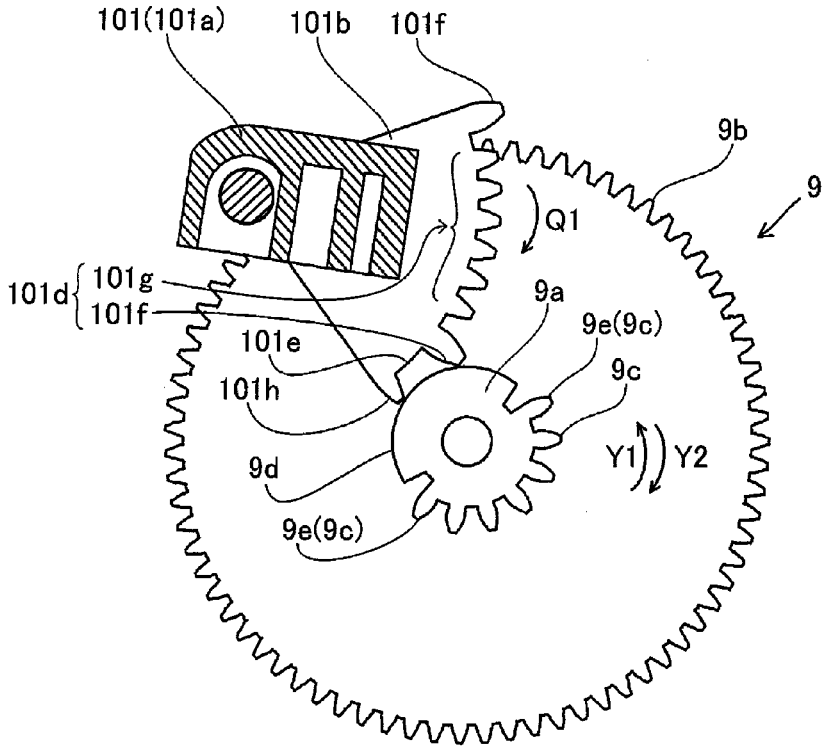

As shown in FIG. 19, the driven gear portion 101*b* has a toothed portion 101*h* provided on a region other than the toothed portions 101*d* and the toothless portion 101*e*. The toothed portion 101*h* is an example of the "fifth toothed portion" in the present invention. When the print head 2 (see FIG. 20) is most separated from the platen roller 3 (see FIG. 20) upward (along arrow P2 in FIG. 20) and the small-diametral gear portion 9*a* of the driving gear 9 and the toothed portions 101*d* of the driven gear portion 101*b* of the print head rotating member 101 are out of mesh in nonprinting, one of the toothed portions 101*f* and the toothed portion 101*h* of the driven gear portion 101*b* hold the small-diametral gear portion 9*a* of the driving gear 9 over the toothless portion 9*d* of the small-diametral portion 9*a* of the driving gear 9, as shown in FIG. 22. In this case, the side surfaces of one of the toothed portions 101*f* and the toothed portion 101*h* of the driven gear portion 101*b* slidably come into contact with the toothless portion 9*d* of the small-diametral gear portion 9*a* of the driving gear 9, thereby holding the small-diametral gear portion 9*a* of the driving gear 9.

Figure 23:
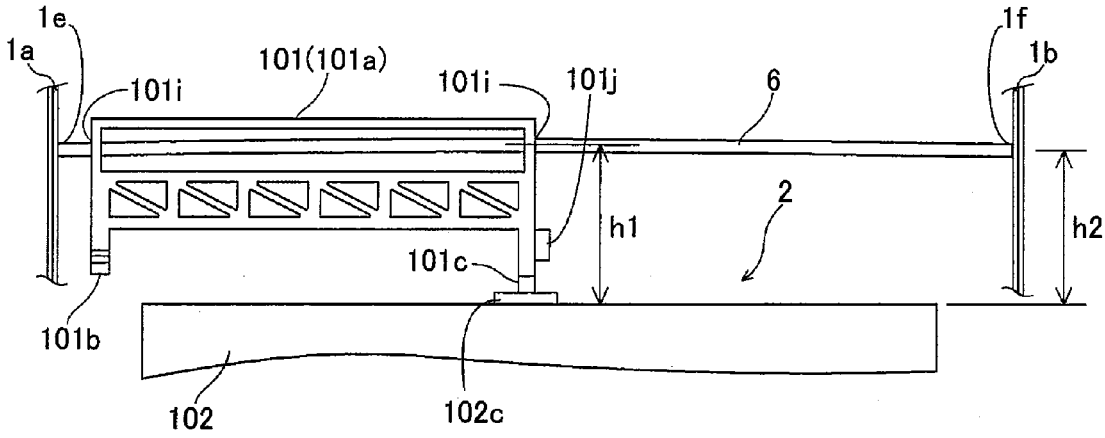
FIG. 23 is a diagram for illustrating the print head rotating member in the sublimatic printer according to the second embodiment shown in FIG. 17.

The print head rotating member 101 is provided with receiving holes 101*i* receiving a support rod 6 of metal. The print head rotating member 101 is rotatable around the support rod 6 inserted into the receiving holes 101*i*. The receiving holes 101*i* are so formed that the distance h1 between the upper surface of the print head 2 and the receiving holes 101*i* is larger than the distance h2 between the upper surface of the print head 2 and support holes 1*e* and 1*f* for the support rod 6 provided in first and second side surfaces 1*a* and 1*b* of a chassis 1 respectively when the pressing portion 101*c* is in contact with the upper surface of the print head 2 in printing, as shown in FIG. 23. When the pressing portion 101*c* is in contact with the upper surface of the print head 2 in printing, therefore, the support rod 6 is so deflected that the axial center thereof protrudes upward, whereby the print head 2 is pressed from above through the pressing portion 101*c* due to downward restoring force of the support rod 6. Consequently, the print head 2 is pressed toward the platen roller 3 in printing.

According to the second embodiment, a push-up portion 102*a* pushed up by a protrusion 101*j* provided on the print head rotating member 101 upon upward rotation of the print head rotating member 101 is integrally formed on the center of the heat radiating member 102 by uprighting. When the print head rotating member 101 is rotated upward (along arrow P2), therefore, the protrusion 101*j* of the print head rotating member 101 pushes up the push-up portion 102*a* of the heat radiating member 102 thereby rotating the print head 2 in a direction for separating from the platen roller 3, as shown in FIG. 20.

Figure 24:
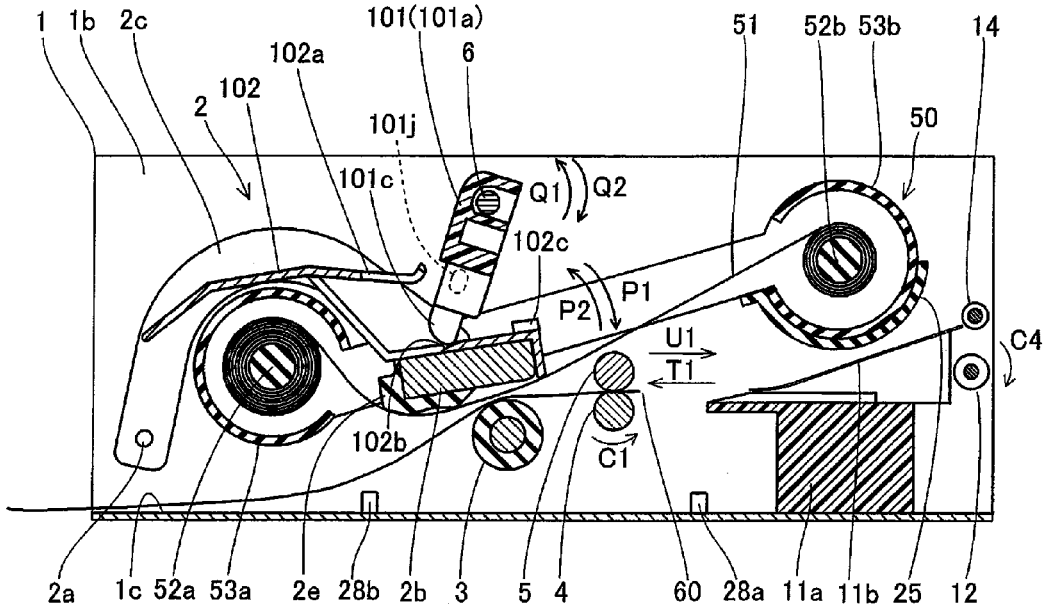
FIGS. 24 and 25 are sectional views showing the internal structure of the sublimatic printer according to the second embodiment shown in FIG. 17.

An edge 102*b* of an opening resulting from formation of the push-up portion 102*a* by uprighting is smoothly inclined upward. When the print head rotating member 101 is rotated downward (along arrow P1), therefore, the pressing portion 101*c* of the print head rotating member 101 smoothly slides on the edge 102*b*, whereby the pressing portion 101*c* can easily move toward the upper surface of the heat radiating member 102, as shown in FIGS. 24 and 25.

Figure 25:
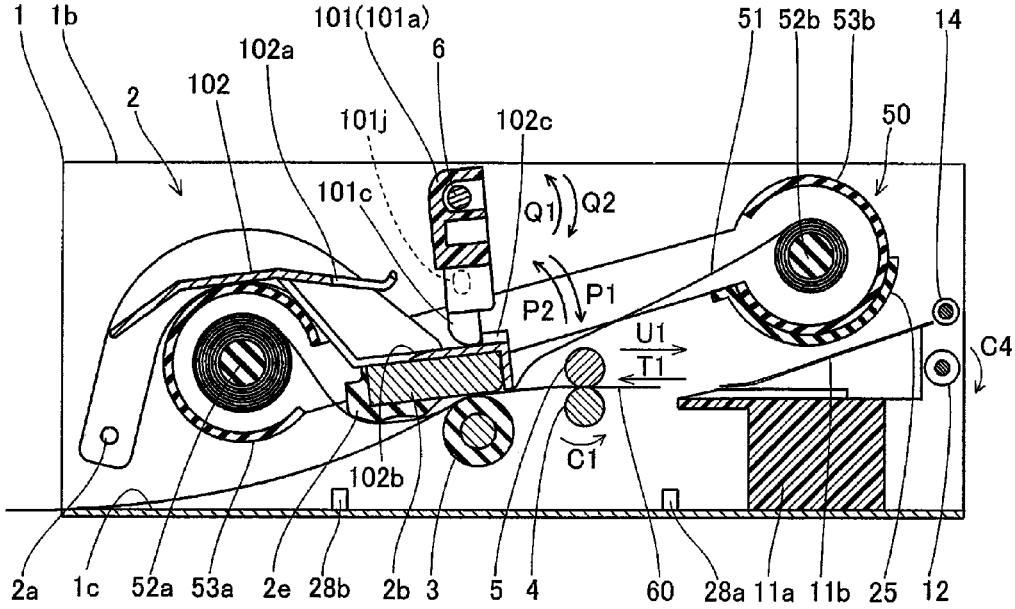

As shown in FIG. 25, a stop portion 102*c* is integrally provided on an end of the upper surface of the heat radiating member 102, in order to prevent the print head rotating member 101, rotated until the pressing portion 101*c* reaches the upper surface of the heat radiating member 102, from deviating in the rotational direction (along arrow F).

The remaining structure of the sublimatic printer according to the second embodiment is similar to that of the sublimatic printer according to the aforementioned first embodiment.

According to the second embodiment, as hereinabove described, the print head rotating member 101 is provided with the heat radiating member 102 mounted on the print head 2 for radiating heat generated in the print head 2 while the pressing portion 101*c* of the print head rotating member 101 is rendered rotatable and the heat radiating member 102 is integrally provided with the push-up portion 101*a* pushed up by the pressing portion 101*c* upon rotation of the pressing portion 101*c* so that the pressing portion 102*a* of the heat radiating member 102 pushes up the push-up portion 102*a* of the heat radiating member 102 upon rotation of the pressing portion 101*c* thereby moving the heat radiating member 102 and the print head 2 in the direction for separating from the platen roller 3, whereby the pressing portion 101*c* pushes up the push-up portion 102*a* with rotational force upon rotation for easily rotating the heat radiating member 102 and the print head 2 in the direction for separating from the platen roller 3 without requiring a transmission mechanism portion transmitting the rotational force of the pressing portion 101*c* to the heat radiating member 102 and the print head 2. Consequently, increase in the number of components can be suppressed.

According to the second embodiment, the pressing portion 101*c* presses the print head 2 toward the platen roller 3 in printing while the heat radiating member 102 is provided with the stop portion 102*c* preventing the pressing portion 101*c* pressing the print head 2 toward the platen roller 3 in printing from deviating in the rotational direction so that the pressing portion 101*c* does not deviate in the rotational direction in printing, to be capable of reliably pressing the print head 2 toward the platen roller 3.

According to the second embodiment, the pressing portion 101*c* of the print head rotating member 101 is made of resin, whereby noise resulting from the pressing portion 101*c* sliding on the support rod 6 of metal upon rotation can be suppressed as compared with a case where the pressing portion 101*c* is made of metal.

The remaining effects of the second embodiment are similar to those of the aforementioned first embodiment.

Although the present invention has been described and illustrated in detail, it is clearly understood that the same is by way of illustration and example only and is not to be taken by way of limitation, the spirit and scope of the present invention being limited only by the terms of the appended claims.

For example, while each of the aforementioned first and second embodiments is applied to the sublimatic printer employed as an exemplary image generating apparatus, the present invention is not restricted to this but is also applicable to another image generating apparatus other than the sublimatic printer, so far as the same comprises a print head for printing images while pressing a platen roller with prescribed pressing force.

While the print head rotating member 7 or 101 is formed by working a sheet metal member in each of the aforementioned first and second embodiments, the present invention is not restricted to this but a print head rotating member integrally including a driven gear portion, a pressing portion and a rotating shaft may alternatively be provided by resin molding or the like.

While one of the toothed portions 9*e* of the small-diametral gear portion 9*a* and the corresponding one of the toothed portions 7*f* or 101*f* of the driven gear portion 7*b* or 101*b* first mesh with each other when the small-diametral gear portion 9*a* of the driving gear 9 and the driven gear portion 7*b* or 101*b* of the print head rotating member 7 or 101 mesh with each other in each of the aforementioned first and second embodiments, the present invention is not restricted to this but more than one (e.g. two) toothed portions 9*e* and more than one (e.g. two) toothed portions 7*f* or 101*f* may alternatively first mesh with each other.

While the pressing portion 7*c* or 101*c* of the print head rotating member 7 or 101 presses the portion around the cross-directional center of the print head 2 in each of the aforementioned first and second embodiments, the present invention is not restricted to this but pressing portions may alternatively be arranged on positions (both ends of the print head 2, for example) capable of uniformly pressing the print head 2 on positions other than that around the cross-directional center of the print head 2.

What is claimed is:

1. An image generating apparatus comprising:

a print head for printing images while pressing a platen roller with prescribed pressing force;

a driving gear portion including a first toothed portion provided in a prescribed rotation angle range and a first toothless portion provided on a region other than said first toothed portion; and a print head rotating member integrally including a driven gear portion having a second toothed portion provided in said prescribed rotation angle range and a second toothless portion provided on a region other than said second toothed portion for meshing with said driving gear portion and a pressing portion pressing said print head, wherein said driving gear portion is so formed that the diameter of the outer peripheral surface of said first toothless portion is smaller than the tip diameter of said first toothed portion, and said driving gear portion is so arranged that said first toothless portion of said driving gear portion slides on said second toothed portion of said driven gear portion of said print head rotating member in the vicinity of a position where said print head presses said platen roller with said pressing portion of said print head rotating member.

2. The image generating apparatus according to claim 1, wherein said second toothed portion of said driven gear portion is constituted of a third toothed portion and a fourth toothed portion provided in said prescribed rotation angle range, the tip diameter of said third toothed portion is larger than the tip diameter of said fourth toothed portion, while at least one end of said fourth toothed portion is arranged adjacently to said third toothed portion, and said first toothed portion of said driving gear portion and said third toothed portion of said driven gear portion first mesh with each other when said driving gear portion and said driven gear portion of said print head rotating member mesh with each other.

3. The image generating apparatus according to claim 2, wherein the root diameter of said first toothed portion of said driving gear portion engaging with said third toothed portion of said driven gear portion is smaller than the diameter of the outer peripheral surface of said first toothless portion.

4. The image generating apparatus according to claim 1, wherein said driven gear portion further has a fifth toothed portion provided on another region of said driven gear portion other than said second toothed portion and said second toothless portion, and said third toothed portion and said fifth toothed portion of said driven gear portion hold said driving gear portion over said first toothless portion of said driving gear portion when said first toothed portion of said driving gear portion and said second toothed portion of said driven gear portion of said print head rotating member are out of mesh.

5. The image generating apparatus according to claim 1, wherein said pressing portion of said print head rotating member is so arranged as to press a portion around the cross-directional center of said print head.

6. The image generating apparatus according to claim 1, wherein the number of bottoms of said first toothed portion of said driving gear portion is identical to the number of tips of said second toothed portion of said driven gear portion.

7. The image generating apparatus according to claim 1, wherein said driving gear portion is so arranged that said first toothless portion of said driving gear portion slides on the side surface of one end of said second toothed portion of said driven gear portion in the vicinity of a position where said print head presses said platen roller with said pressing portion of said print head rotating member.

8. The image generating apparatus according to claim 1, wherein said print head rotating member further includes a heat radiating member mounted on said print head for radiating heat generated in said print head, said pressing portion of said print head rotating member is rendered rotatable, said heat radiating member is integrally provided with a push-up portion pushed up by said pressing portion upon rotation of said pressing portion, and said push-up portion of said heat radiating member is so pushed up by said pressing portion upon rotation of said pressing portion that said heat radiating member and said print head move in a direction for separating from said platen roller.

9. The image generating apparatus according to claim 8, wherein said pressing portion presses said print head toward said platen roller in printing, and said heat radiating member includes a deviation preventing portion preventing said pressing portion from deviating in the rotational direction when said pressing portion presses said print head toward said platen roller in printing.

10. The image generating apparatus according to claim 1, wherein said pressing portion of said print head rotating member is made of resin.

11. An image generating apparatus comprising:

a print head for printing images while pressing a platen roller with prescribed pressing force;

a driving gear portion including a first toothed portion provided in a prescribed rotation angle range and a first toothless portion provided on a region other than said first toothed portion; and a print head rotating member integrally including a driven gear portion having a second toothed portion provided in said prescribed rotation angle range and a second toothless portion provided on a region other than said second toothed portion for meshing with said driving gear portion and a pressing portion so arranged as to press a portion around the cross-directional center of said print head, wherein said driving gear portion is so formed that the diameter of the outer peripheral surface of said first toothless portion is smaller than the tip diameter of said first toothed portion, said driving gear portion is so arranged that said first toothless portion of said driving gear portion slides on said second toothed portion of said driven gear portion of said print head rotating member in the vicinity of a position where said print head presses said platen roller with said pressing portion of said print head rotating member, said second toothed portion of said driven gear portion is constituted of a third toothed portion and a fourth toothed portion provided in said prescribed rotation angle range while said driven gear portion further has a fifth toothed portion provided on another region of said driven gear portion other than said second toothed portion and said second toothless portion, the tip diameter of said third toothed portion is larger than the tip diameter of said fourth toothed portion, while at least one end of said fourth toothed portion is arranged adjacently to said third toothed portion, said first toothed portion of said driving gear portion and said third toothed portion of said driven gear portion first mesh with each other when said driving gear portion and said driven gear portion of said print head rotating member mesh with each other, the root diameter of said first toothed portion of said driving gear portion engaging with said third toothed portion of said driven gear portion is smaller than the diameter of the outer peripheral surface of said first toothless portion, and said third toothed portion and said fifth toothed portion of said driven gear portion hold said driving gear portion over said first toothless portion of said driving gear portion when said first toothed portion of said driving gear portion and said second toothed portion of said driven gear portion of said print head rotating member are out of mesh.

12. The image generating apparatus according to claim 11, wherein the number of bottoms of said first toothed portion of said driving gear portion is identical to the number of tips of said second toothed portion of said driven gear portion.

13. The image generating apparatus according to claim 11, wherein said driving gear portion is so arranged that said first toothless portion of said driving gear portion slides on the side surface of one end of said second toothed portion of said driven gear portion in the vicinity of said position where said print head presses said platen roller with said pressing portion of said print head rotating member.

14. The image generating apparatus according to claim 11, wherein said print head rotating member further includes a heat radiating member mounted on said print head for radiating heat generated in said print head, said pressing portion of said print head rotating member is rendered rotatable, said heat radiating member is integrally provided with a push-up portion pushed up by said pressing portion upon rotation of said pressing portion, and said push-up portion of said heat radiating member is so pushed up by said pressing portion upon rotation of said pressing portion that said heat radiating member and said print head move in a direction for separating from said platen roller.

15. The image generating apparatus according to claim 14, wherein said pressing portion presses said print head toward said platen roller in printing, and said heat radiating member includes a deviation preventing portion preventing said pressing portion from deviating in the rotational direction when said pressing portion presses said print head toward said platen roller in printing.

16. The image generating apparatus according to claim 11, wherein said pressing portion of said print head rotating member is made of resin.

* * * * *